United States Patent [19]

Sohm

[11] 4,057,341

[45] Nov. 8, 1977

[54] DUAL MODE CONTROL LOGIC FOR A MULTI-MODE COPIER/DUPLICATOR

[75] Inventor: Lawrence R. Sohm, Fairport, N.Y.

[73] Assignee: Xerox Corporation, Stamford, Conn.

[21] Appl. No.: 528,163

[22] Filed: Nov. 29, 1974

Related U.S. Application Data

[63] Continuation of Ser. No. 393,546, Aug. 31, 1973, abandoned.

[51] Int. Cl.[2] ..... G03G 15/28

[52] U.S. Cl. ..... 355/8; 355/14; 355/51

[58] Field of Search ..... 355/3 R, 8, 11, 14, 355/47-51, 66; 328/37, 72-75

[56] References Cited

U.S. PATENT DOCUMENTS

| | | | |
|---|---|---|---|
| 3,352,218 | 11/1967 | Ostensen | 355/14 X |
| 3,588,472 | 6/1971 | Glaster et al. | 355/14 X |
| 3,652,157 | 3/1972 | Blackert et al. | 355/11 |
| 3,674,363 | 7/1972 | Baller et al. | 355/50 X |
| 3,677,635 | 7/1972 | Van Auken et al. | 355/51 X |
| 3,684,367 | 8/1972 | Vassitch | 355/14 X |
| 3,689,143 | 9/1972 | Case et al. | 355/3 R |
| 3,813,157 | 5/1974 | Fantozzi | 355/51 X |
| 3,833,296 | 9/1974 | Vola et al. | 355/57 X |
| 3,900,258 | 8/1975 | Hoppner et al. | 355/8 X |

OTHER PUBLICATIONS

"Dual Mode Copying System," IBM Technical Disclosure Bulletin, vol. 12, No. 1, p. 173.

*Primary Examiner*—L. T. Hix
*Assistant Examiner*—Kenneth C. Hutchison

[57] ABSTRACT

Control circuitry is disclosed for operating stations in an automatic electrophotographic reproducing machine in either of two modes to make copies of different sizes. In one mode a document is held stationary while moving scanning elements move past it to form a scanned image, and in the second mode the scanning elements are held stationary while a document feeder feeds sheet documents past the scanning elements. The control circuity includes a multiplexer for gating appropriate signals to the various stations according to the mode in which the machine is operating.

5 Claims, 16 Drawing Figures

| | | |
|---|---|---|
| FIG. 6 | FIG. 7 | FIG. 8 |
| FIG. 9 | FIG. 10 | FIG. 11 |

TO 68,76 OR 78
DEVF
MAIN DRIVE
CHARGE F
FANSF
EXPOF
SCANF
FUSER F
ADD PAPER LAMP 51
71A
71B
71C
71D
71E
71F
71G
MR
ON
OFF
72A
72M
72B
72N
72C
72O
72L
72P
72E
72Q
72F
72R
72G
72S
75
COIN F
70
HOLD COUNT
74
73
CTR
53
FD
PD
COIN SET
60 Hz
COPIES MADE
COPY # DESIRED

ADD PAPER
COINF SET
LDC BILL
EXPOF MPX (PRINT DISABLE)
EXP MPX
DEVF MPX
LDC DEV. BIAS
RESET MPX
SCAN MPX
127V. DC
"WAIT"
LDC PAPERFEED INHIBIT
BF II
R 18
R28
R6
Q5
EXPOF
DONE L
00
01
02
04
64
286
121
122
123
124
131
132
133
134
141L
141B
142L
142B
143L
143B
144L
144B
151
153
154
161
162
163
164
121M
122M
123M
124M
+5V. DC 221
222
284
111
113
DONE
Q
S
R
MR
C10
C11
FUSER
LD15
VIA115
219
231
281
121
217
130
a
b
c

LDC CYCLE

DUAL MODE CONTROL LOGIC FOR A MULTI-MODE COPIER/DUPLICATOR

FIELD OF THE INVENTION

This is a continuation of application Ser. No. 393,546 filed Aug. 31, 1973, now abandoned.

This invention relates to a copier/duplicator machine designed to operate in different modes and more particularly, to a control apparatus which enables the machine to change from one mode to another automatically once mode change is started.

BACKGROUND OF THE INVENTION

Use of control circuitry for generating signals necessary to operate various devices or control elements in a machine is generally known. For example, xerographic copier/duplicator machines based on Chester Carlson's invention in the electrostatographic copying principles usually includes control means for implementing various steps involved in making xerographic copies; for example, means for charging a photosensitive insulating layer, imagewise exposing the layer, developing the image with toner, transferring the image on a sheet of paper, removing the sheet, heat fusing the transferred image on the sheet, and cleaning the layer for subsequent use, etc. The means for achieving these steps include certain controlled elements for implementing the various xerographic processing steps; for example, means responsive to a signal for actuating the main drive motor of the machine, common generating means for charging the photosensitive insulating layer or transferring the image on the layer onto the transfer sheet or copy paper, magnetic brush developer means, means for cleaning the layer, scanner carriage and optical scanning means for projecting the image of the original onto the photosensitive insulating layer, jam detection means, etc. The machine is usually provided with a suitable control logic circuitry for generating appropriate signals required to actuate or energize the various controlled elements in a timed sequence so that the xerographic steps are properly implemented.

Heretofore, generally the copier/duplicator was designed to operate in a single mode in making copies of the original. For example, the typical machine was designed so that its optical scanning arrangement moved past an original in a stationary position, or in the alternative, the scanning arrangement was held in a fixed or a stationary position while the document original was fed past the scanning arrangement in making copies up to a certain size. Such machines had an inherent limitation, in that, for example, they were capable of making copies only up to certain given size, such as legal size paper (8 ½ inches × 14 inches), but not capable of making copies on a sheet which is larger than this given size.

More recently, however, there was developed a copier/duplicator machine which is capable of operating in more than one mode of operation for making copies of different sizes. An example of such a machine is described in detail in the copending case, U.S. application Ser. No. 284,687, filed on Aug. 29, 1972, now abandoned and replaced by continuation application Ser. No. 367,996, filed on June 7, 1973, now U.S. Pat. No. 3,900,258, both applications being assigned to the same assignee as the present invention. As described in the application, the machine is designed so that in a first or base mode of operation a moving optical scanning means is used in scanning a stationary original and in a second or LDC mode of operation the scanning arrangement is stationary and the document original is moved past a scanning station by a document feeding means. The machine is designed so that, in the base mode, it can make copies in normal letter size, (e.g., 8 ½ inches × 11 inches) and up to legal size (e.g., 8 ½ × 14 inches) and in the LDC mode or Large Document Copy mode, copies up to 14 inches × 18 inches can be made.

SUMMARY OF THE INVENTION

It is an object of the present invention to provide a control circuitry for operating a copier/duplicator in different modes to make copies from different size document originals.

It is another object of the present invention to provide an improved control circuitry for enabling a copier/duplicator machine to operate in different modes to make copies of different sizes.

The foregoing and other objects of the present invention are achieved according to the present invention by providing a control circuitry for operating the machine in different modes.

It is a feature of the present invention to provide a control circuitry adapted to operate with a xerographic copier/duplicator for making copies of different sizes in different modes from document originals of different sizes.

It is another feature of the present control circuitry to key the starting and stopping of the xerographic copying process steps to the size of the document original.

It is still further feature of the present control circuitry to key the copying steps to the size of the copy sheets.

It is another further feature of the present control circuitry to utilize a first and second logic means in operating the machine in the first or in second mode of operation.

It is still another feature of the present control circuitry to utilize a multiplexing means for selecting the outputs of the first and second logic means in a manner to minimize the number of logic elements used.

The foregoing and other objects and features of the present invention will be made clearer from the following detailed description of an illustrative embodiment of the present invention in conjunction with the accompanying drawings, in which.

Figures 3, 12:
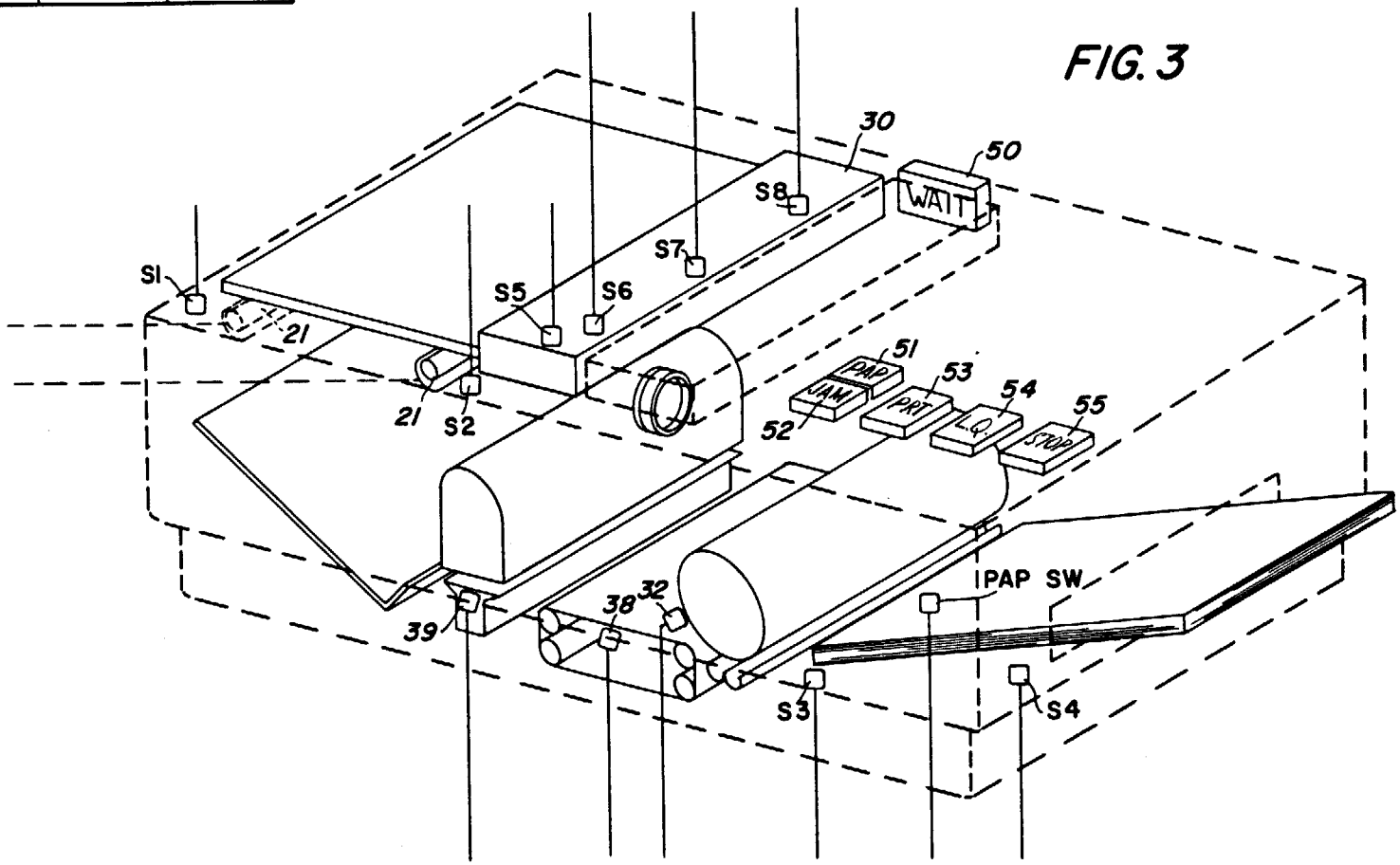
FIG. 3 shows a perspective schematic view of the machine that shows certain switches and operator controlled elements involved in the mode changing operation of the machine.

FIG. 6 - 11 when combined in the form of FIG. 12, show the auxiliary control circuitry in detail.

Figure 13:
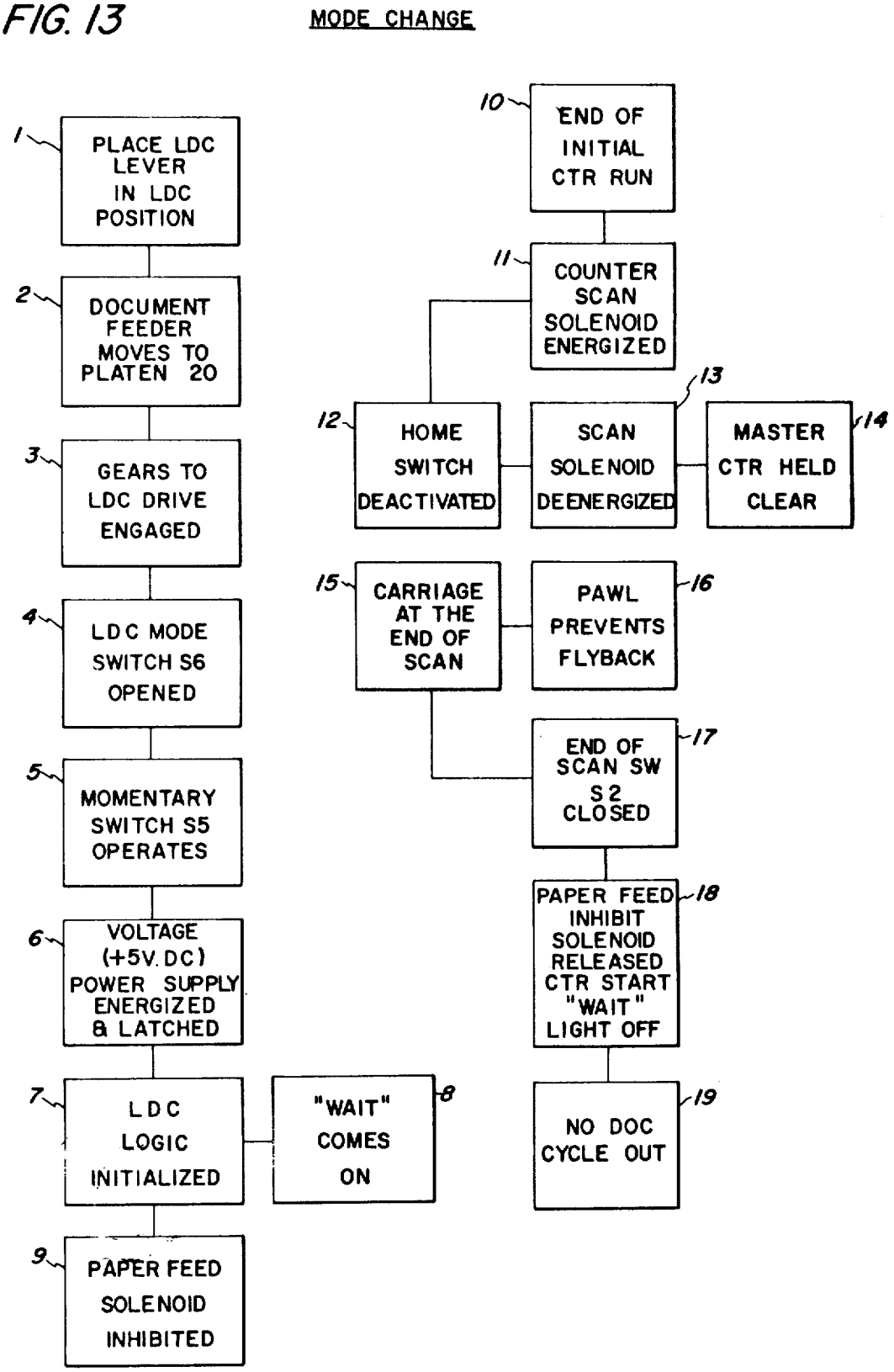

FIG. 13 shows an operational flow chart helpful in describing and understanding the operation of the control apparatus providing a mode changing operation from the base to the LDC mode.

Figure 14:
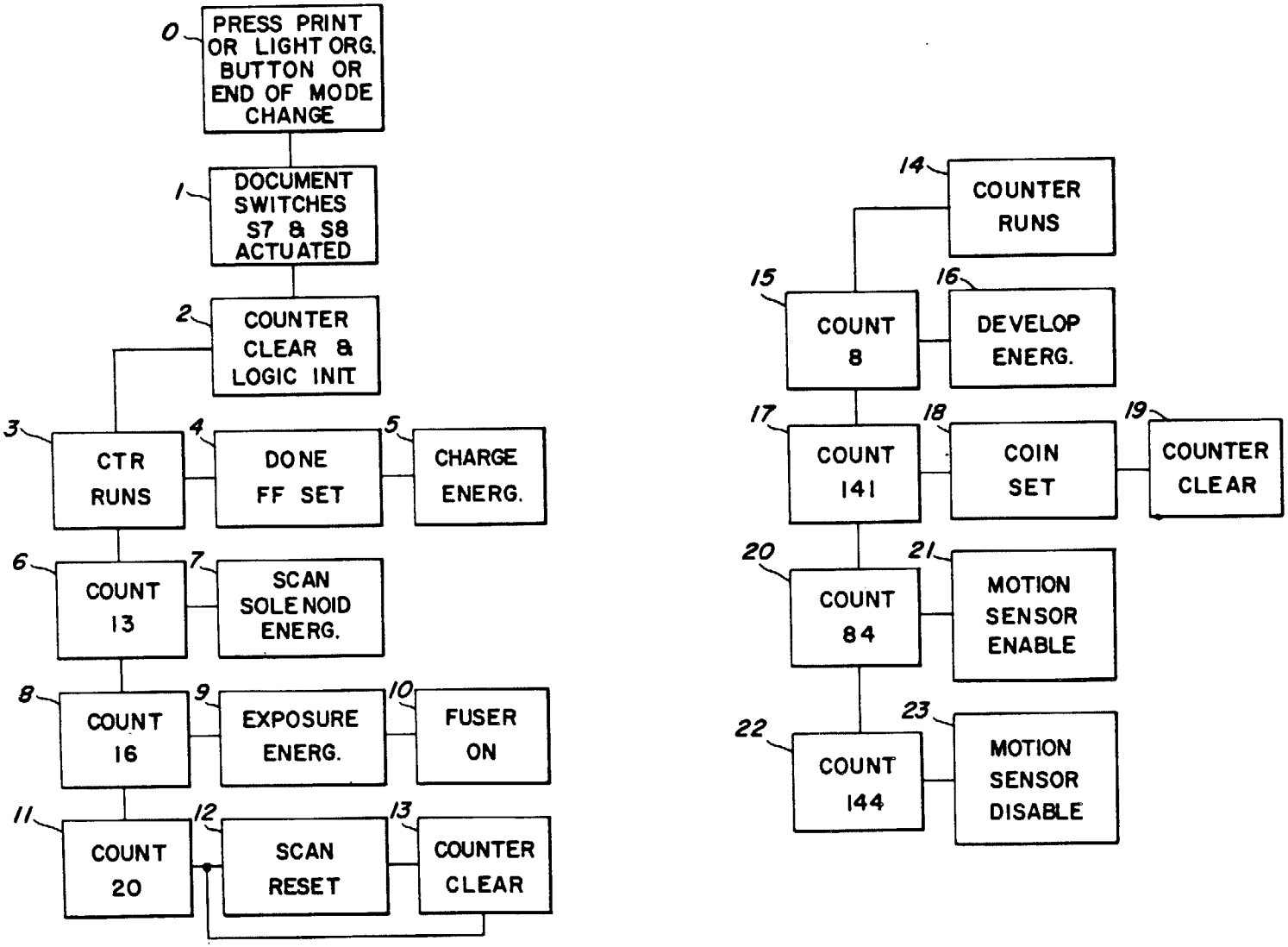

FIG. 14 shows another operational flow chart helpful in describing and understanding the operation of the control apparatus and various elements of the copier/-duplicator machine when the same is operating in the LDC mode.

Figure 15:
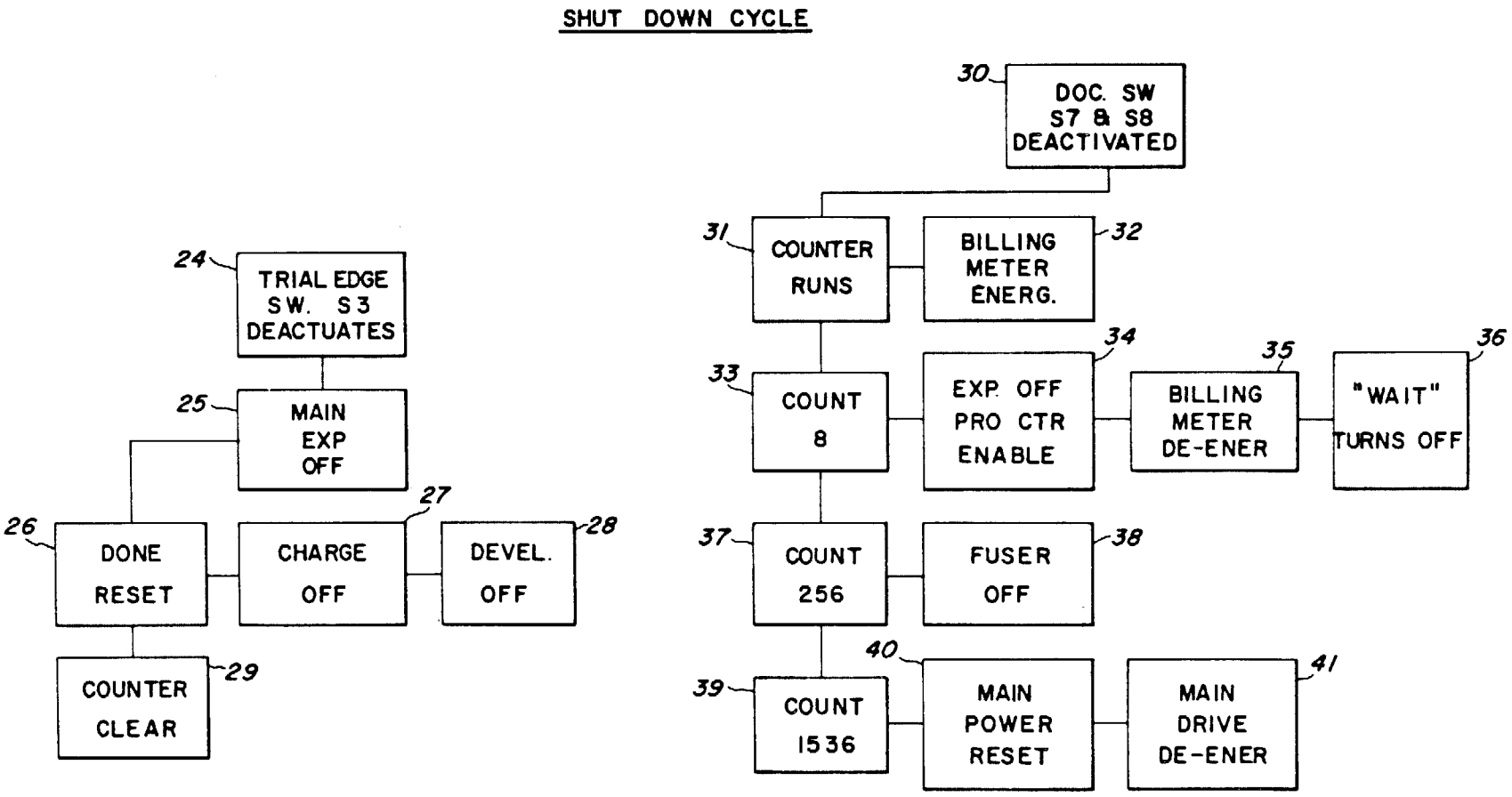

FIG. 15 shows an operational flow chart helpful in describing and understanding the operation of the control apparatus.

Figure 16:
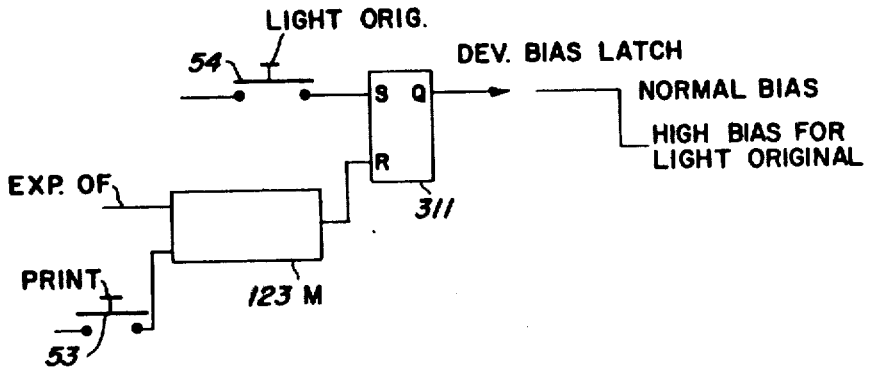

FIG. 16 shows a portion of the logic redrawn to show the interrelationship of the LIGHT ORIGINAL and PRINT button and the LDC logic.

DESCRIPTION OF THE ILLUSTRATIVE EMBODIMENT OF THE PRESENT INVENTION

Figure 1:
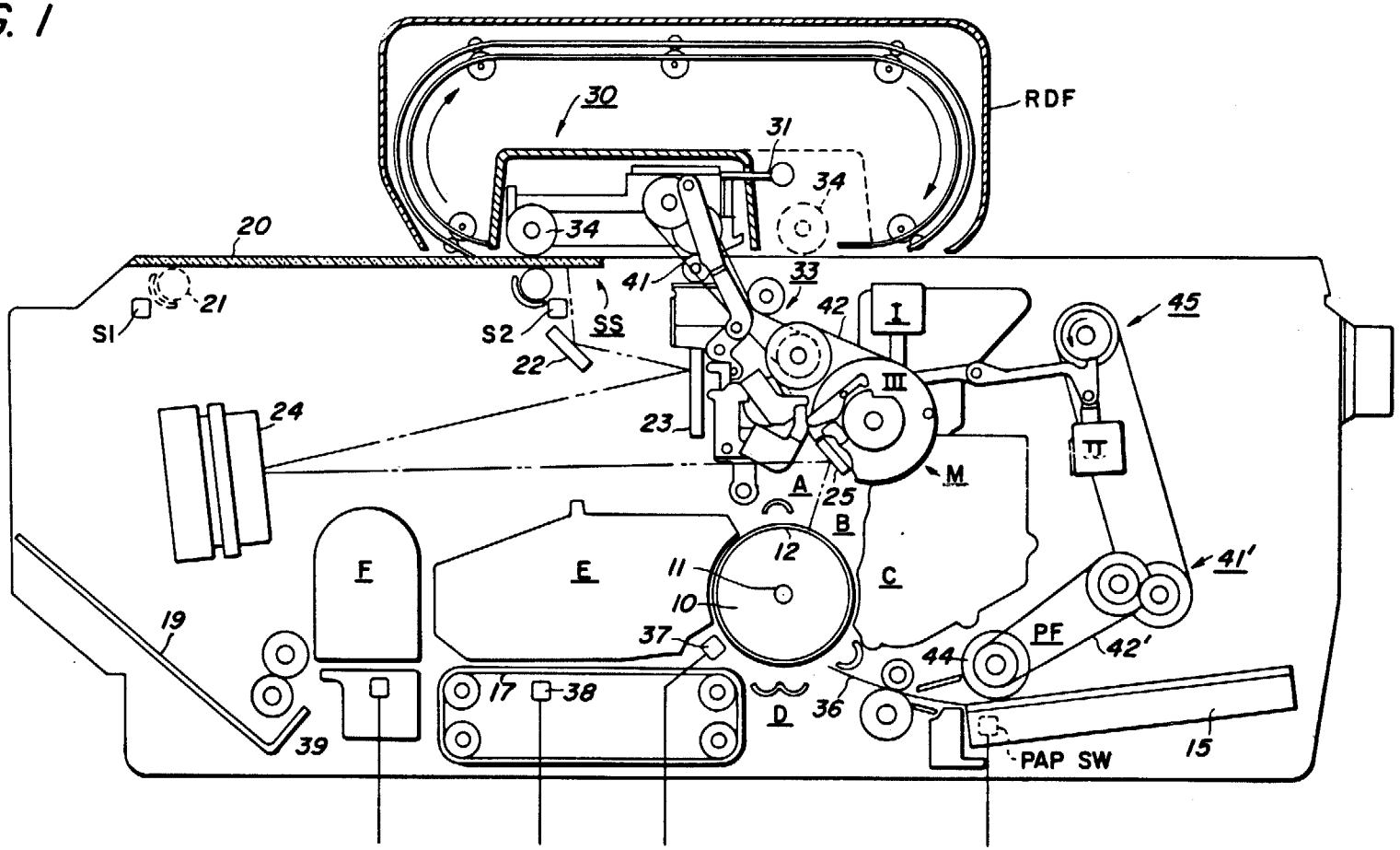
FIG. 1 shows a frontal schematic view of a copier/duplicator in which control circuitry according to the present invention may be utilized.

The control circuitry of the present invention will be described in the context of xerographic copier/duplicator machine of a specific design. However, it should be noted from the outset that although the description is in the context of the xerographic machine, the scope of the present invention is not limited to the xerographic machine. Clearly as will be evident from the following description, the principles of the present invention can be applied to other types of machines having similar operational requirements. Now referring to the drawings, as shown in FIG. 1, a xerographic copier/duplicator machine typically includes various elements for implementing xerographic steps. It comprises a drum 10 that may be driven clockwise about an axis 11. The drum includes a photosensitive insulating layer surface 12 around the periphery of which various controlled elements are situated; namely, charging means A, imagewise exposing means B, developing means C, image transfer D, cleaning means E, and fusing means F, etc., for effecting the usual steps involved in making xerographic copies. The machine may be further provided with a suitable feeding means PF for feeding copy sheets of paper from a paper supply in a cassette 15 and a suitable paper transfer means 17 for transferring the imaged paper onto the fusing station F where the toner image is fused onto the paper and then paper feed out to a suitable receptacle means 19.

As described in the copending application Ser. No. 367,996 mentioned above, a subject xerographic copier/duplicator machine may be designed to operate in different modes. In a first, or base mode, conventional sized documents up to a certain size are copied and in a second or LDC mode larger sized documents are processed. For example, in the base mode, the machine is designed to employ a moving optical scanning arrangement 21 - 24 to scan a stationary original placed on a platen 20 in making copies up to 14 inches in length and 8.5 inches in width. In the LDC mode, it is designed so that the scanning arrangement is held at a stationary position and the document original is moved past a scanning station SS.

Figure 2:
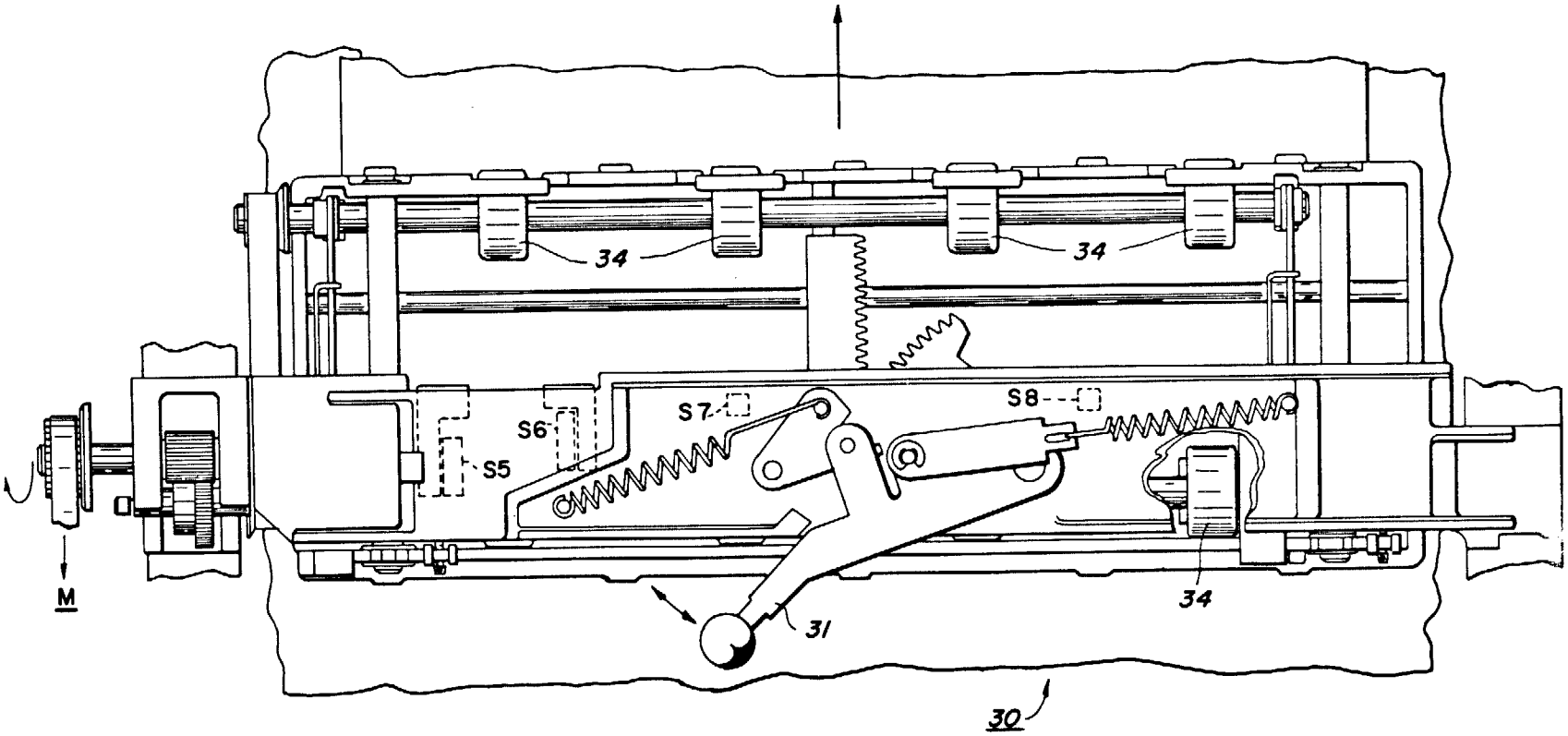
FIG. 2 shows a schematic top view of an auxiliary document original feeder that may be used as an accessory to the base machine when the machine is operated in the auxiliary or LDC mode.

Referring to FIGS. 1 - 3, in base mode operation, the scanning arrangement 21 is moved across the width of the platen 20 by a carriage (not shown) so that the associated optical means 22 - 25 projects the image of the original on the xerographic drum surface 12 at the image exposing station B. In base mode operation, the machine is designed so that, in each copy run after the initial warm-up period, each successive xerographic copying cycle is accomplished in the same given time interval. The cycle time starts as the scanning means leaves the home position near the scan start sensing switch S1 and continues to move past the platen and ends as it reaches the end of scan position at the scan end sensing switch S2. The next cycle begins as the scanning means automatically flies back to the home position.

In the LDC mode of operation, a large document original is fed through a feeding means 20 such as that shown in a pending U.S. application Ser. No. 205,911 filed on Dec. 8, 1971, now abandoned, and refiled as U.S. application Ser. No. 649,777, filed Jan. 16, 1976 or in U.S. Pat. No. 3,731,915 issued to Guentner. For example, as shown in the forementioned copending application Ser. No. 284,687, the document feeding means 30 may be stationed outside of the platen 20 and be in a disengaged position when the machine is to operate in the base mode as shown in dotted lines (FIG. 1). It includes a lever 31 which is designed so that by moving it clockwise the feeding means 30 is brought into or engaged into a position as shown in solid lines so that it can feed documents for the LDC mode. Thus, in this position, the document original can be fed past the scanning station SS. A suitable mechanism 33 is provided in the machine for coupling feed rollers 34 to the main drive M when the document feeding means 30 is moved to the LDC position. Once engaged, the rollers 34 driven by the main drive M feeds the document original to the left past the scanning station SS. The speed with which the paper is fed past the scanning station SS is synchronized with the speed with which the copy paper 36 from the paper cassette 15 is fed into a transfer relationship with the photosensitive insulating layer 12 by a suitable paper feeding means PF. When it is desired to operate the machine in the base mode, the document feeding means is simply moved out of the way of the platen by rotating the lever 31 in a counterclockwise direction. The counter clockwise rotation of the lever 31 moves the document feeding means 30 to the right shown in dotted lines and out of the path of the scanning station SS. At the same time, the driving mechanism 33 disengages the feed rollers 34 from the main drive M to render the document feeding means inoperative. While in the illustrative embodiment, it is shown that the document original feeding means is moved from one position to another to engage or disengage the machine in the LDC mode, it need not be so limited. For example, the document feeding means could be held at a fixed stationary position using suitable actuating means such as a push button to engage or disengage document feed rollers and thus selectively engage the feeding means for the LDC mode.

In the base mode, control circuitry of conventional design may be used to provide signal necessary for the selective enabling of certain elements such as charging, exposing, developing, image transferring, fusing and cleaning means that implement the steps necessary in making a copy. The circuitry may comprise electromechanical or electronic components such as that shown in the U.S. Pat. No. 3,301,126, as issued to R. F. Osborne et al. on Jan. 31, 1967, or that shown in application Ser. No. 348,828, filed on Apr. 6, 1973, now U.S. Pat. No. 3,813,157, which acts to implement various xerographic process steps at appropriately timed intervals at various point in the processing operation under conditions where necessary timing is derived from a clock or cam mechanism or other suitable means. Generally, as described in the above mentioned copending application Ser. No. 367,996 for base mode operations, the timing of the xerographic copying cycle is keyed to the scanning operation of the scanning means. Thus, in the base mode, each cycle of xerographic processing steps during the making of successive copies in a copy run is keyed to the start and end of the scanning operation involving the movement of the scanner carriage between the home position (at switch S1 in FIGS. 1 or 3) and the end of scan position (at switch S2 in FIGS. 1 or 3).

In addition, the control circuitry is also provided with a suitable design such as that shown in U.S. Pat. No. 3,588,472, as issued to Thomas H. Glaster et al. on June 28, 1971, or in U.S. Pat. Ser. No. 344,322, filed on Mar. 23, 1973, now U.S. Pat. No. 3,832,065, for detecting various malfunctions of the machine. For example, referring to FIGS. 1 and 3, the machine may include detack detecting means 37 for detecting the failure of copy paper separation from the drum surface 12, jam detection means 38 for detecting a paper jam that may occur along the paper path, and heat sensing element 39 for monitoring the temperature of the fusing station F. The outputs of these detecting means form a part of the input signals to the control circuitry of the present system.

In the present machine, various sensing elements in the form of switches are used to provide certain necessary input signals to the control circuitry. These switches are shown schematically in FIGS. 2 and 3, and, briefly stated, they provide the following functions:

S1 — switch S1 is used for providing a signal indicative of the fact that the scanning element 21 is at the home or start position of the scan cycle. This will be referred to, in the alternative, as a "home switch". It is designed so that it is actuated when the scanning element 21 is at the home position. In the actuated condition it is closed and provides ground or a logical 0 signal.

S2 — switch S2 is used to sense the positioning of the end scan position as shown in FIGS. 1 and 3. This switch will be referred, in the alternative, as the "end of scan" switch. It is normally open but it is actuated to close when the scanning element 21 reaches the end of the scan position. When actuated it provides ground and a logical O signal.

S3 — switch S3 (FIG. 3) is utilized to detect the trailing edge of a copy paper sheet. It is normally closed. Upon detection of the trailing edge, it opens and provides a logical 1 signal.

S4 — switch S4 is utilized to sense the presence of a large size paper or LDC paper cassette 15 in the paper tray. It is normally open. But it closes in the presence of a LDC paper cassette.

Figure 4:
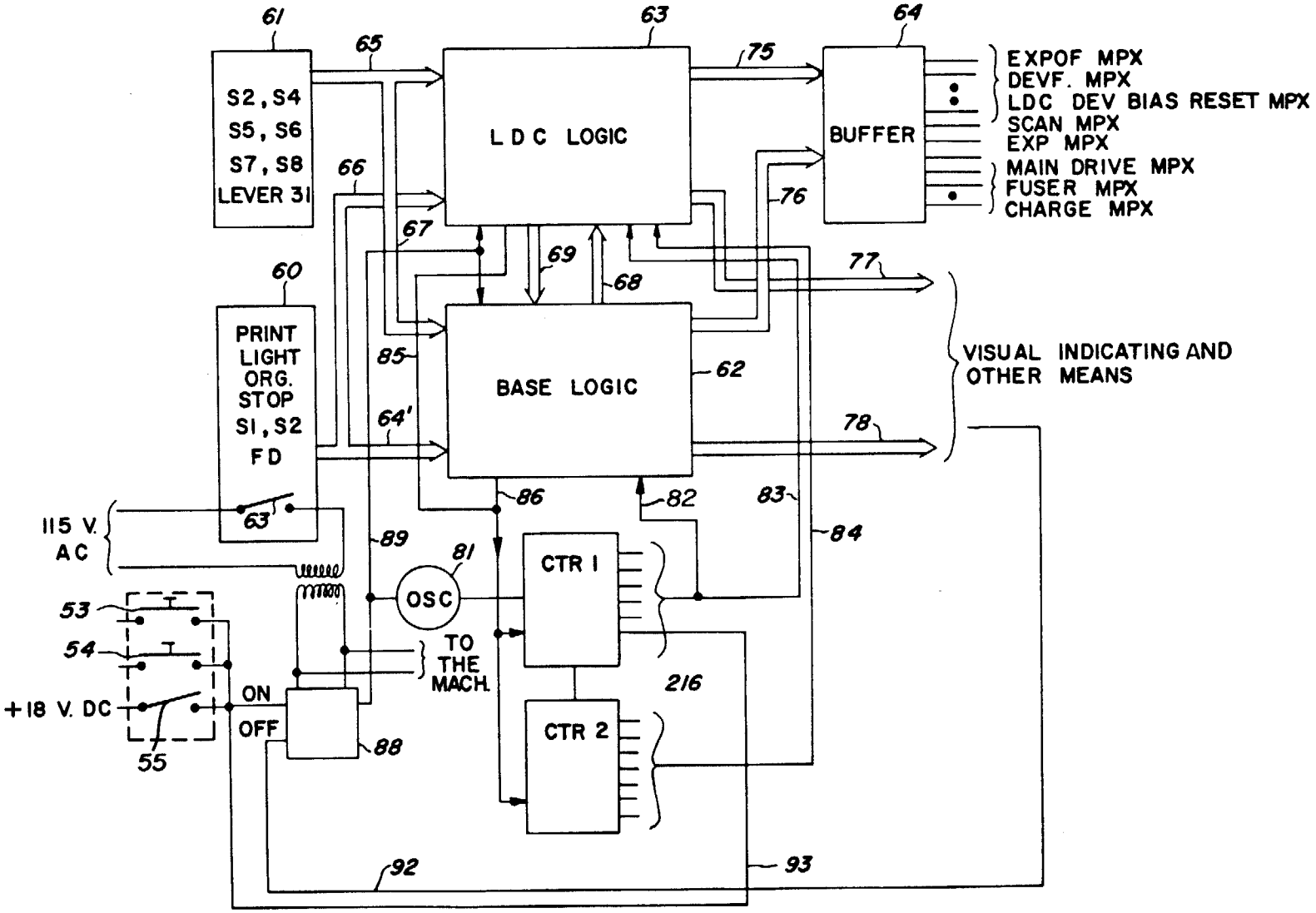
FIG. 4 shows a functional block diagram of the control apparatus of the present invention.

S5 — switch S5 is positioned to sense the movement of the document feeding means 30 into the LDC mode position. It is normally in the open state. It is a a momentary switch that actuates or closes momentarily as the document feeding means 30 moves into the operative position for the LDC mode of operation. It is designed so that it initializes the control circuitry. S5 is connected so that when actuated, it momentarily provides +18 volts D.C. to a +5 volt D.C. regulator and triggers it into operation, thereby supplying the necessary +5 volts D.C. to initialize or start various circuit elements of the control circuitry. (FIG. 4). The momentary switch S5 may be a one way rollover type switch that actuates in a first direction when the machine goes from the base mode to the LDC mode but not in the opposite direction. Switch S5 will be referred to as the "mode change" switch alternatively.

S6 — switch S6 is a step-wise switch which is actuated to an open condition as the document feeding means 30 moves to the LDC mode position from base mode position. It is normally closed. Upon actuation to an open condition, it provides a logical 1 signal to the logic circuit. The logical 1 signal from this switch is utilized by the LDC control circuitry as an indication of the change in the mode of operation of the machine from the base mode to the LDC mode and of the operation of the machine in the LDC mode. This switch will be alternatively referred to as LDC mode switch.

S7 and S8 —these two switches are utilized to sense leading and trailing edges of the document original being fed into the document feeding means 30. The switches are normally closed and they are connected in series, but they open in the presence of the document original to signify its presence. They are positioned in the path of the document original so that at least one or the other will sense the presence of a paper of even a narrow width. Operation of either or both is utilized to signify the presence of the document original, the leading and trailing edges of the document original.

Briefly stated, the switches S1 — S8 above are connected to operate and provide the following functions. The home switch S1 when actuated shows that the scan carriage is at the home position. The end of scan switch S2 is in a non-actuated condition at this point. Now suppose the operator wishes to operate the machine in an LDC or large document copy mode. The lever arm 31 is moved clockwise to place the document feeding means 30 to the left and thereby place the machine in the large document copying mode. As the lever arm 31 is rotated, the LDC mode switch S6 is actuated and then the switch S5 is momentarily actuated. This initializes the control circuitry for the LDC mode of operation.

In response to such initializing, the control circuitry causes the scanning arrangement and associated optics to move into the LDC position, that is, to the end of the scan position associated with switch S2. Furthermore, the control logic associated with LDC mode of operation is so designed that the action of copy paper feed solenoid II in selectively feeding copy paper is prevented or inhibited while the scanning arrangement and the optics 21 - 25 move to the end of the scan position. The arrival of the scanning elements at the end of the scan position is sensed by the end of scan switch S2. Upon a detection of this condition by switch S2 the scanning and optic elements are retained in the end of scan position by the enabling of a suitable pawl and ratchet mechanism. For a detailed discussion of an exemplary mechanism of this type, one may refer to the copending application Ser. No. 284,687. This prevents the scan carriage means from automatically returning to the home switch position as done in base mode operations and when the scanning means reaches the end of scan position, the main drive M drives the document original feed rollers 34.

In response to the end of scan signal, the control circuitry removes the constraints on the operation of the solenoid II to allow the copy paper feeding means PF to selectively operate. With the solenoid enabled, the drive belt means 41' and 42' are prevented from engaging with the main drive M and no copy paper is fed. When solenoid II is de-actuated the control logic, in response to actuation of the LDC document original sensing means S7 and S8 as the document original passes thereby causes engagement of the drive belt means, and the main drive M is allowed to drive the copy paper feed rollers 44 in synchronism with the speed with which the document original is fed past the scanning station SS. The switches S7 and S8 actuate as the document original paper is fed therepast in the paper feeding means 30 and enables the control logic to proceed with LDC mode of copying operation. Absent any malfunction, the machine proceeds to complete the copying operation.

In the shut down phase of the LDC mode of operation, somewhat different steps are involved, as shall be more fully explained, depending upon whether the trailing edge sensing switch S3 of the copy paper is sensed before or after the trailing edge of the document original is sensed by the document original sensing switches S7 and S8.

There are a number of indicating means that may be provided in the copier/duplicator machine, as shown in FIG. 3, to provide the following functions:

WAIT — This is visual indication means 50. It is connected in a manner to provide the "Wait" indicia when the document feeding means 40 is moved to the LDC position, and this condition is maintained by the control circuitry until the scanning element 21 moves to the end of the scan position and the machine is ready to make copies. The lighted indicating means 50 comes to the view of the operator during this time and alerts the operator to wait until the indication terminates before the document original sheet is fed through the feeding means 30. The indicating means 50 may include a suitable notation "WAIT" for the operator's convenience. Preferably, the indicating means 50 may be positioned above the console of the base machine as shown in FIG. 3 at a position where it will be hidden by the housing of the paper feeding means 30 when the same is positioned for base mode operation.

ADD-PAPER — An indicating means 51 "Add Paper" is provided to apprise an operator that attention to the paper supply is necessary. It may be so connected that it is energized by the control circuitry when the paper supply runs out or when the incorrect size paper supply is present.

CLEAR PAPER PATH — The indicating means 52 is provided to signify to the operator that a paper jam condition is present and requires clearing.

In addition, certain push buttons are provided in the machine for inputting certain command signals to the control circuitry. For example:

PRINT — This input, button 53, is used to enable the operator to start the machine in the base mode or in the alternative in the LDC mode if the machine is already in the LDC mode.

LIGHT ORIGINAL — This input, button 54, serves the function of starting an appropriate machine cycle when the original has poor background quality and the operator wishes to remove the background and obtain a copy with a cleaner background. If the machine is in the base mode, it may be placed in the LDC mode by moving the lever arm clockwise; movement of the lever is accomplished by the operation of the momentary switch S5 and the LDC mode switch S6 to provide the print command signal. However, if the machine is already in the LDC mode then a depression of either the PRINT button 53 or LIGHT ORIGINAL button 54 provides the print command signal.

STOP — The STOP input, button 55, is used for stopping the machine in the middle of its operation and causes the control circuitry to stop the machine at the end of the copying cycle in process.

The logic of the present control circuitry is configured so that when operated in the LDC mode, the machine operates in a single cycle or copy mode, wherein one copy of a document original is made at a time. The copy cycle in an LDC mode is such that a copying cycle is started when the machine is placed in the LDC mode, the copy is formed and completed and thereafter a shutdown mode is initiated after a given delay. In each copy cycle in the present embodiment, a copy of up to a given size, for example, 14 inches in length and 18 inches in width, is made. If the original is wider than 18 inches, then a succeeding cycle of the copying process may be employed to complete the copying of the remainder of the original on a succeeding copy sheet.

Because of the flexibility and versatility built into the logic of the control circuitry, the operation of the machine need not, however, be limited to that specifically set forth for the base and LDC modes of operation described above. For instance, the machine can be run so that in the LDC mode, the machine may be employed as a single copy machine for small size copies ranging up to 8.5 inches in width and 14 inches in length in size, although this mode is primarily designed to make large sized copy. The machine can also be run as a multicopy system in the LDC mode by providing a suitable means RDF (FIG. 1) designed to refeed a document original coming out of the document feeding means 30 back to input thereof before the machine is shut down by the control logic.

The general functions of the control circuitry according to the instant invention are described with reference to the block diagram of FIG. 4. The control circuitry according to the present invention generally includes input means 60 for applying various command or input signals to the control logic which are required to operate the machine either in a base mode or LDC mode. Another input means 61 is provided for applying other required command or input signals to the control circuitry when the machine is operated in the LDC mode. The control circuitry is also provided with base logic 62, LDC logic 63, and a buffer 64 for selectively conveying output control signals from the base and LDC logic for operating the controlled elements of the xerographic machine.

The input signals provided from input means 60 to the base logic 62 include the manual command inputs such as provided by the PRINT, LIGHT ORIGINAL, and STOP buttons, as well as sensor inputs such as provided by the home position scan switch S1, the copy paper edge sensing switch S3, the failure condition detection means FD which includes the jam detecting means, the detack detecting means, the means for sensing an over heating of the fuser, etc., and machine interlock INTLK switch 63 which may be used to switch in or out an AC power source. These inputs are applied from the input means 60 to the base logic 62 via suitable paths 64'. The input signals provided from the input means 61 to the LDC logic 63 include input signals responsive to the movement of the LDC lever arm, the end of scan switch S2, the LDC cassette switch S4, the momentary or mode changing switch S5, the LDC mode switch S6, and document edge sensing switches S7 and S9. These inputs are applied to the LDC logic 63 via path 65.

In accordance with another aspect of the present invention, the control circuitry is configured so that, whenever possible, the input signals used for the base machine are also used for the logic for the LDC mode of operation to thereby simplify structure and render the machine more versatile. Thus, for example, the inputs from a number of input means such as PRINT, LIGHT ORIGINAL, ADD PAPER, CLEAR PAPER PATH and STOP are used to provide command signals for operating the machine in the base mode and are also applied to the LDC logic 63 via suitable paths 66 for controlling machine operation in the LDC mode. Similarly, other input means such as jam, detack and other failure detecting means are also employing as inputs to the LDC logic 63. In a like manner certain of the inputs to the LDC logic are also applied via suitable paths 67 to the base logic 62. In addition, as shall be evident from the detailed discussion below, certain outputs of the base logic 62 are also employed in the LDC logic 63 and the converse relation also obtains as indicated by flow paths 68 and 69.

Generally stated, the LDC logic of the present invention is designed to operate in conjunction with existing logic (i.e., base logic 62) circuitry previously employed to control base mode operation.

Figure 5:
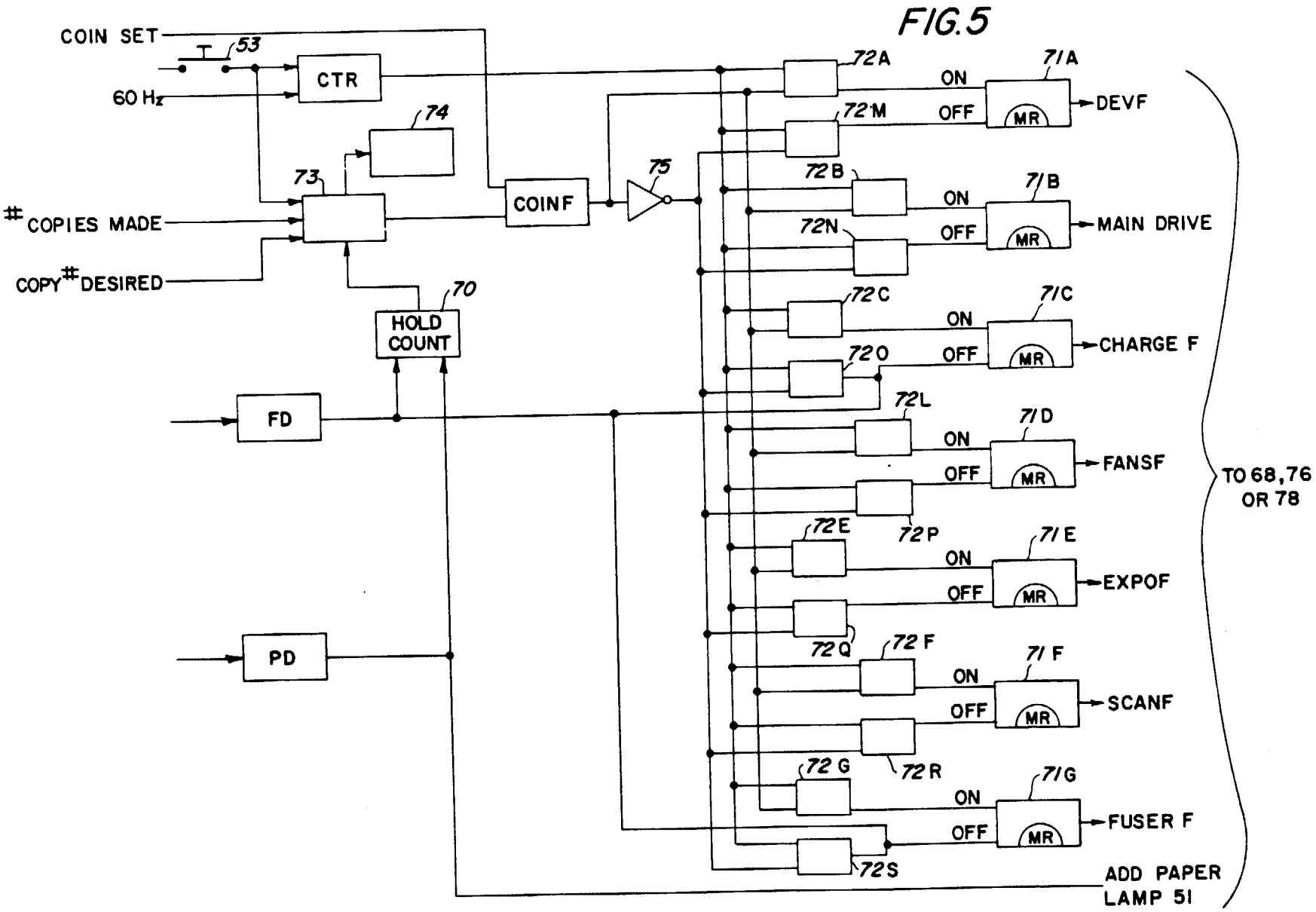
FIG. 5 shows a functional block diagram of base logic that may be used for the base mode of operation of the control apparatus.

As illustrated in FIG. 5, the basic logic circuitry may comprise a plurality of latch means 71A - 71G that provide signals (DEVF, MAIN DRIVE, CHARGE, FANSF, EXPOF, SCANF, and FUSERF) for actuating means for implementing xerographic steps. These steps include charging, developing, exposing, motor driving, scanning, fusing, cooling steps, etc. The control logic includes a timing signal generating means CTR, and a plurality of logic or decision gates (72A - 72G) for setting or resetting (72M - 72S) the latches (71A - 71G) to effect xerographic steps in a certain time sequence upon actuation of the start or print button 53. In addition, the base control logic may also comprise suitable programmable means 73, such as described in U.S. application Ser. No. 344,321, as filed on Mar. 23, 1973, now abandoned and refiled as U.S. application Ser. No. 548,037, now U.S. Pat. No. 3,971,919, for setting different break points and billing meters 74 for recording the count of copies made. Briefly stated, the programmable means 73 is designed to store the number of copies dialed by the operator, readies operation in response to the initialization of the machine, and upon a depression of the start or or print button 53 is designed to count and generate copy count pulses for application to the billing meters 74. It is also designed to generate an output signifying coincidence between the number of copies made and the number of desired copies, as dialed by the operation. This coincidence signal is applied to a coincidence latch COINF (FIG. 5). In turn the coincidence latch COINF applies a signal via an inverting gate 75, to suitable decision gates 72M, 72N - 72S, for deactuating or resetting the latch means 71A - 71G which were set or actuated earlier by the decision gates 71A - 71G to implement the xerographic process steps. The logic may also comprise machine failure detecting means FD of suitable type such as detack detect means (FIG. 1, 37), jam detect means (38), fuser overheat detect means 39 and paper supply run out condition detecting means PD for detecting a run out condition of copy paper supply from paper supply switch PAP SW. When the paper supply run out condition is detected, a visual means 51, ADD PAPER is illuminated to signify the condition. Upon a detection of the failure conditions associated therewith, the detecting means FD and PD provide output signals to a count hold means 70 that cause the programmable means 73 to suspend its counting operation and also deactivate latch means 71A - 71G through the generation of a false coincidence signal to thereby interrupt the machine operation while signals from failure detecting means FD are employed to directly reset latches 71C and 71G. For a more detailed description of examples of the aforementioned type of base logic, reference to the U.S. Pat. No. 3,588,472 or the pending U.S. applications Ser. Nos. 348,828 and 344,321 filed on Apr. 6, 1973 and Mar. 23, 1973, and now U.S. Pat. Nos. 3,813,157 and 3,971,919 respectively is available.

As stated above, according to an aspect of the present invention, the LDC logic is designed to operate with existing base logic 62 of the type briefly described above. Therefore, as shown in FIG. 4, wherever possible, it is designed to utilize the outputs of the base logic 62 which is supplied thereto via paths 68. Furthermore, the LDC logic is also designed so that where possible outputs developed thereby are usable by the base logic 62 and accordingly these outputs are supplied to the existing base logic 62 via paths 69 for completing the logical operation necessary in deriving control signals, as will be described in more detail hereinbelow.

In line with an object of utilizing existing logic elements to a high degree to reduce resulting structure, various logic elements are employed to perform multiple functions. Thus, for example, referring to FIG. 4, buffer 64 is used to multiplex the signals from the base logic 62 via suitable paths 76 for operating control elements for the various xerographic process steps. Likewise, count information derived from programmable means 73 (FIG. 5) is also utilized in deriving LDC billing count information, as described in a detailed copending application Ser. No. 393,545, filed concurrently with the present application now abandoned and refiled as U.S. application Ser. No. 562,536, now U.S. Pat. No. 3,989,930. The base mode logic as well as the LDC mode logic provides other output signals which are applied via suitable paths 77 and 78, respectively, as shown in FIG. 4, to various means such as the visual indicating means to alert the operator as to machine status conditions.

In line with the object of maximum utilization of the logic elements, a counter CTR1 used for the base logic 62 is also used in providing necessary timing signals in operating various elements of the machine in the LDC mode. This is schematically indicated in FIG. 4, wherein, it is shown that the counter CTR1 which is connected to the output of an oscillator 81 provides necessary timing signals to the base logic 62 via suitable paths 82 and to the LDC logic via other paths 83.

Where the counter CTR1 for base mode operation in a given machine does not include enough counting capacity, a second counter CTR2 may be connected in series therewith to derive extended time counts as may be required by the LDC logic and apply them to the LDC logic via suitable paths 84. When required during a copying operation, the counters CTR1 and CTR2 are cleared by deriving and applying clearing signals from the base mode or LDC mode logic and applying them to the counters via suitable paths 85 and 86.

As described below, the counter CTR1 starts when either the PRINT button 53 or LIGHT ORIGINAL button 54 is pressed in the base mode or when the momentary switch S5 is actuated when the LDC document feeding means 30 moves into the LDC position. With the machine interlock switch 63 closed, the actuation of the buttons 53 and 54 or the momentary switch S5 provides a trigger signal required to trigger a suitable D.C. regulator 88, such as a +5 v. D.C. regulator, into conduction. Once triggered into conduction, the regulator converts the 115 volt, 60 Hertz A.C. power to a D.C. output. The D.C. output is applied via suitable path 89 to the various elements of the logic, other elements of the base and LDC logic and the oscillator.

In accordance with another aspect of the present invention, as will be described in detail below, certain count signals are utilized as a feedback signal via a suitable path 92 to the D.C. voltage regulator 88 and turn it off and shut down the machine at the end of a copying operation. Similarly, in certain situations, once triggered into operation, another count signal is fed via a feedback path 93 to maintain the operation of the D.C. voltage regulator subsequent to triggering.

In the base mode operation, the control signal outputs are generated in a certain timed sequence by the base logic and this timing sequence is keyed to the operation of the scanning means which moves past a stationary document original. These control signals are then employed to actuated in an appropriately timed sequence the control elements that implement the xerographic steps. When the machine is operated in the LDC mode, however, the timing and actuation of the controlled elements are different in a number of ways. For instance, the copying operation is now keyed to the stationary scanning means and a displaceable document original. Hence, in the LDC mode, for example, the command signals for displacing the scanning means and optics in synchronism with copy paper are not required. Furthermore, there are time differences in the actuation of xerographic operational steps because of variations in the size of the document original and copy sheet size. To accommodate the different environment, the LDC logic is designed to control the actuation of the operational steps in a manner to conform to the size of the document original and/or that of the copy sheet.

In addition, the LDC logic is designed to accommodate various additional input functions exclusive to the LDC mode of operation such as those associated with the input signals from the mode change switch S5, LDC mode switch S6 and document feed switches S7 and S8. The LDC logic responds to these LDC mode related inputs, analyzes them and provides outputs to the controlled elements of the xerographic machine via the buffer circuit 64 to effect copying steps in a timed sequence especially suited to making copies of large sized document originals of different size copy sheets, in a manner to be described in detail below.

DETAILED DESCRIPTION OF THE CONTROL CIRCUITRY

Referring now to FIGS. 6 - 11, the control circuitry of the present invention is considered in detail. The LDC logic 63 is designed to respond to the various input signals from the input signal means 60 and 61, as applied thereto through paths 65 and 66, and the outputs from the base logic 62, applied via paths 68, certain ones of said paths being designated LD1 - LD21. The inputs LD1 - LD21 from the base logic 62 are annotated with conventional binary logic notation to readily facilitate an appreciation of their nature. For example, the symbol $\overline{FD}$ is a failure detection input such as from jam detections means or other machine failure (FIG 5) in the base logic wherein the letters represent the nature of the input while the bar or Not factor sign is indicative that this input is high or is a logical 1 when the condition is absent. Conversely, if the failure condition exists, this input is low or logic 0, and it is applied via the LD1 path to interrupt and stop the operation of the LDC logic. In a like manner, when the developer (FIG 1;C) is off (i.e., not activated this condition is signified by a logical 1 for $\overline{DEVF}$ lead from the development latch (FIG. 5; 71A) of the base logic and applied to the LDC logic via LD2, as shown. Similarly, other inputs are:

$\overline{MAIN\ DRIVE}$ — refers to the condition of the main drive M as indicated by the output of latch 71B (FIG. 5) wherein this input is high when the main drive M is not running and low or at a logical 0 when it is running.

SCAN — refers to the ouput of the scan latch 71F of the base logic. It is high or at a logical 1 when the scanning means 21 (FIG. 1) in the base mode is operating and is low or at a logical 0 when the scanning means is not operating.

EXPOF — refers to the condition of the actuating signal for the exposure means B (FIG. 1) being provided by the exposure latch 71E (FIG. 5) in the base logic. A high or logical 1 level is indicative that an enabling signal is being provided while a low or Zero (0) indicates the converse.

PRINT — refers to the print signal. A logical 1 level appears when the PRINT or LIGHT ORIGINAL button is pressed while a logical 0 appears when these buttons have not been depressed.

PAPSW — refers to the output of the paper sensing switch PAPSW. When copy paper is present a logical 1 resides on this line, otherwise logical 0 is present.

$\overline{LDC\ START\ PRINT}$ — indicates whether an LDC print cycle has been initiated by a depression of the print or light original buttons. A logical 1 or high is present on this input when the PRINT button 53 (FIG. 3) has not been depressed, the machine is in the LDC mode and the start of the copy cycle was commenced by changing the mode from base to LDC by a moving of the lever arm 31 clockwise (See FIGS. 1 and 2).

CT 13 $2^2$, $2^3$M, $2^4$M, $2^1$u, $2^0$U — refers to counter signal outputs corresponding to count conditions 13, 4, 8 and 16 of the first counter CTR 1, and 2 and 1 of second counter CTR2, respectively. When the corresponding count conditions from the counters CTR1 and CTR2 occur, they are provided in the form of logical 1's to the corresponding inputs associated with conductors LD9, LD11, LD13, LD19, LD20 and LD21 and therethrough to the LDC logic. For example, when count condition 13 is sensed at the output of the first counter CTR1, a logical 1 is applied to conductor LD9.

$\overline{DEVF}$ — refers to the complement of DEVF output produced by latch 71A (FIG. 5) as mentioned above. Thus when developer C (FIG. 1) actuating signals are provided by the development latch 71A (FIG. 5) from the base logic 62, the $\overline{DEVF}$ goes low or to a logical 0 and high when the latch 71A is reset to turn off the development station C (FIG. 1) of the xerographic machine.

HOME SW — refers to a condition when the home switch S1 is in the actuated state corresponding to the presence of scanning elements 21 and 22 (FIG. 2) in the home position. Under these conditions a logical 1 level at the HOME SW input corresponding to a Zero (0) level for switch S1 is applied to the LDC logic through conductor LD12.

$\overline{\text{HOME SW}}$ — refers to the logical complement of the HOME SW input and a logical 1 level resides thereon when the scanning elements 21 and 22 have left the home position at which home switch S1 resides. Thus, when home switch S1 is deactivated or at a logical 1 level, this level is applied to lead LD14.

$\overline{\text{INITIAL}}$ — refers to a condition when the logic is being initialized. When $\overline{\text{INITIAL}}$ output is low, a power up sequence is occurring and this level is employed to reset various latches and gates as will be seen below.

CHARGEF — refers to the condition of latch 71C (FIG. 5) in the base logic 62. When CHARGEF is high such level is indicative that latch 71C is providing a signal for actuating certain charging means of the xerographic machine.

COINF. $\overline{\text{DEVF}}$. MPX— denotes that a logical 1 level resides on line LD17 when the coincidence latch COINF is set and development latch 71A ($\overline{\text{DEVF}}$) is not set.

PROG CLK — is an input associated with the incrementing of the programmer clocks. A logical 1 is present when the programmer clcok in the base logic is being incremented while a logical 0 resides on this input upon the termination of each incrementing signal.

PRINT — is an input associated with the PRINT button. A logical 1 is applied via LD7 to LDC development latch 123M whenever the PRINT button is depressed.

Referring now to FIGS. 8 - 11, the buffer 64 includes multiplexers 121M - 128M which are provided to serve the function of selecting a set of the control signals from either the LDC or the base logic. Thus, for example, the multiplexing circuitry 121M - 128M includes a set of AND gates (e.g., 141L - 148L) for gating therethrough corresponding xerographic process step control signals from the LDC logic and another set of AND gates (e.g., 141B - 148B) for gating therethrough corresponding similar control signals from the base logic. In operation, the AND gates 141L - 148L are enabled by an LDC mode signal from the LDC logic through the INVERTING gates 153 and 155 provided in the multiplexing circuits 121M and 128M wherein AND gates 141L - 144L are commonly connected to the output of inverter gate 153 and AND gates 145L - 148L are commonly connected to the output of inverter gate 155. The AND gates 141B - 148B associated with control outputs from the base logic are disabled by the same LDC mode signal applied to inverting gates 154 and 156. By way of example, the selection process for the multiplexer 124M which controls the scan solenoid is as follows: When the machine operates in the base mode, the signal present on the SCAN input coming from the base logic is applied to the AND gate 144B and will appear on the SCAN MPX output 164 when AND gate 144B is enabled. In the LDC mode the signal present at the output of OR gate 121 of the LDC logic is applied to the AND gate 144L and will appear at the SCAN MPX output upon an enabling of AND gate 144L.

Figure 8:
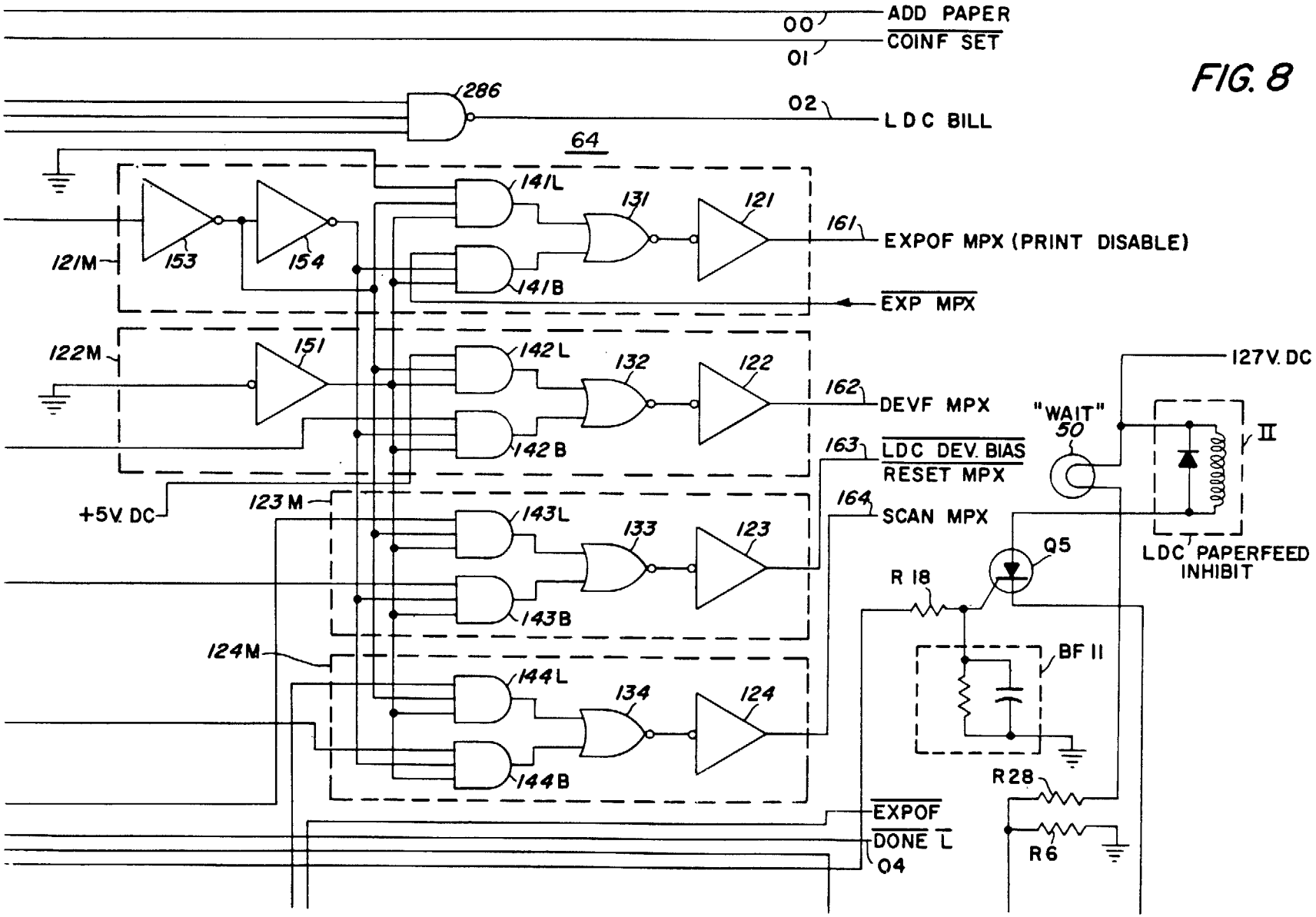
Figure 11:
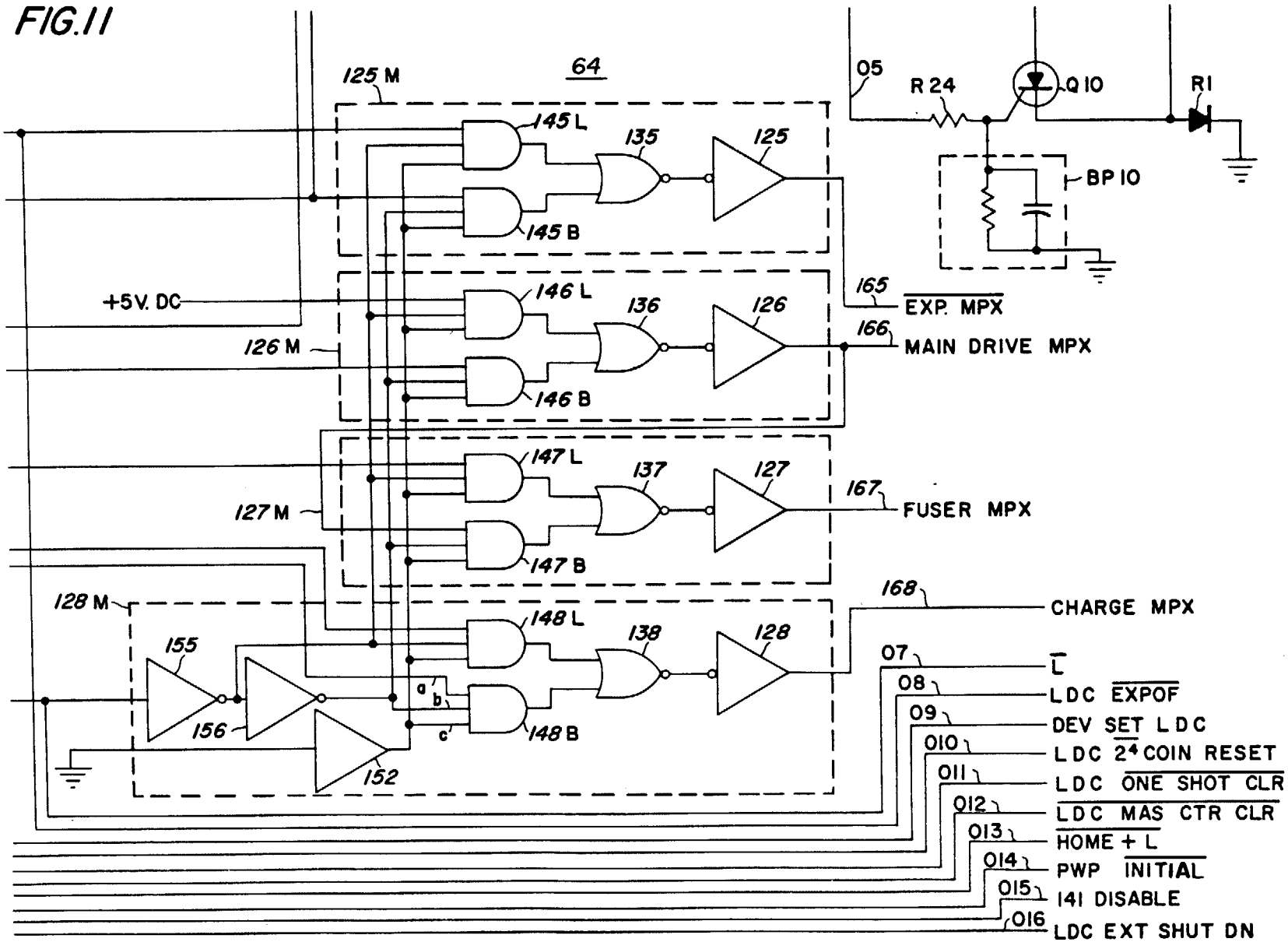

The outputs of the buffer or the multiplexers and the LDC logic are shown along the right hand side of FIGS. 8 and 11. Briefly described, they are as follows:

EXPOF MPX (PRINT DISABLE) — This output on line 161 from the multiplexer 121 is used to actuate or energize the exposure means when the document original being scanned must be image exposed onto a photoreceptor. A One level one line 161 is employed for enabling. The exposure step occurs at the imaging station B (FIG. 1) This signal is also employed to disable the PRINT button in the base mode. The complement of this signal, $\overline{\text{EXPOF}}$, is also applied to the multiplexer 125M as an input to AND gate 145B.

$\overline{\text{DEVF}}$-MPX — This output on line 162 from the multiplexer 122M controls the developing means. With $\overline{\text{DEVF MPX}}$ at a logical 1, the developing means is off and when the level on line 162 is a logical O, the developing means in enabled.

LDC DEV BIAS RESET MPX — When this output signal at 163 from the output of multiplexer 123 is at a logical 1, it is applied to the bias latch (not shown) of the machine and provides a normal bias level.

SCAN MPX — When this output 164 from the multiplexer 124 goes to a logical 1, it energizes the scanning means in the machine.

$\overline{\text{EXP MPX}}$ — This output on line 165 when at a logical 1 level signal is applied to the exposure means to maintain it in a nonactuated state. The same signal is also applied to multiplexer 121M as an input to base mode AND gate 141B.

MAIN DRIVE MPX — This output on line 166 is employed to enable main drive M and cause rotation when a logical 1 is present.

FUSER MPX — This output of line 167 is changed from a ogical 0 to a logical 1 when the fuser in the xerographic machine is to be activated.

CHARGE MPX This output on line 168 goes to a logical 1 when a charging step is taking place. Various inputs or outputs 00-016 of the LDC logic provides the following signals:

ADD PAPER (00) — This output is applied to the ADD PAPER indicator to advise as to a copy paper supply run out condition.

$\overline{\text{COINF SET}}$ — (01) - This output is applied to the base logic and when a logical 1 level is present thereon, it causes a resetting of the coincidence gate latch COINF (FIG. 5) in the base logic.

LDC FILL (02) — This output of line (02) is applied to an LDC billing meter, the details of which are shown in the abovementioned copending application, Ser. No. 393,545.

$\overline{\text{DONE.L}}$ (04) — This output, when at a logical 0, indicates that the machine is in the LDC mode and has completed a copy cycle.

$\overline{\text{L}}$ (07) — This output on line 07, when at a logical 1, signifies that the machine is not in the LDC mode and permits base mode operation.

LDC, EXPOF (08) — This output, when at a logical 0, resets (or turns off) the base mode exposure latch EXPOF (FIG. 5) which normally controls jam detection timing. Since the jam detection requirements of the LDC mode are different from the base mode, a resetting of the exposure latch is necessary.

DEV SET LDC (09) — This output, when at a logical 0, sets the developer latch at the proper time in the LDC mode since the timing for this latch in the LDC mode is different from that required for the base mode. The base mode signal is inhibited by the $\overline{\text{L}}$ output which resides at a logical 0 when the machine is in the LDC mode.

LDC $2^4$ COIN RESET (010) — This output, when at a logical 0, resets the coincidence latch at a count of $2^4$ signifying that the machine has not completed processing a piece of copy paper. This output is used to change COINF. $\overline{\text{DEVF}}$ MPX to logical 0, thereby preventing the base logic from adversely affecting LDC logic.

LDC ONE SHOT CLR (011) — This output when residing at a logical 0, signifies that the LDC one shot has been triggered and causes the counters CTR 1 and CTR 2 to be cleared.

LDC MASTER CTR CLR (012) — This output, when at a logical 1, signifies that the counter CTR 1 is conditioned to count and when at a logical 0, the counter is cleared and held at a count of zero.

HOME $\underline{+L}$ (013) and PWR INIT +L (014) — These outputs are actually the $\overline{L}$ (the complement of L) output. They perform the functions of disabling the HOME switch LATCH (not shown) while in the LDC mode and simulating a power initializing pulse when the machine is changed from the base mode to the LDC mode.

141 DISABLE (015) — This output, when residing at a logical 0, disables a jam check at a count of 141 after the coincidence latch has been set. The jam check is only required for base mode operation where a jam condition is monitored at a time corresponding to count 141 when the last copy set by the operator is made. In the LDC mode, this is not necessary because the jam check is already completed for the single copy mode.

LDC EXT SHUT DN (016) — This output, when residing at a logical 0, shuts off the +5 v DC regulator. The output provided represents a timing count in CTR 1 while the machine is operating in the LDC mode. This extends the shutdown time (e.g., 26 seconds) from a shorter shutdown time (e.g., 16 seconds) employed in the base mode.

Now referring to the details of the LDC logic itself, it may comprise various conventional logic elements such as AND, NAND, OR, NOR, INVERTER, LATCH elements etc., operatively connected to provide logical operation on the various input signals and produce output signals necessary for driving various xerographic elements, lighting visual indicating means and implementing other functions. The LDC logic will now be described in detail in terms of its functions in (a) changing the mode, (b) LDC operation and (c) shut down operation.

a. MODE CHANGE

The mode change described refers to the situation where an operator finds the machine in the base mode and desires to initiate copying operations in the LDC mode on large copy paper, for example, paper larger than legal size paper. The operation first sets up the machine for the LDC mode. The present control is designed so that the operator would place a large size (for example, 18 inches by 14 inches) paper supply in a cassette form in the paper tray 15 (FIG. 1). The LDC lever is then turned clockwise to displace the document feeder to the LDC position. The LDC logic is designed to accept the movement of the level arm, as an equivalent of a pressing of the PRINT button in the base mode. The rest of the operation in making copies is taken over by the control circuitry which automatically places the machine in the LDC mode.

In order to assist in an appreciation of the operatin of the LDC logic, a flow chart (FIG. 13) is provided. Here it is to be noted that the flow chart does not take the usual form of a time dependent flow chart in the sense that each step indicated follows in time the step preceding it. Instead, more of a functional dependency flow chart is illustrated in FIG. 13 wherein the various steps are dependent upon the output conditions of the elements preceding them and various steps may occur simultaneously.

Referring to the details, in particular to FIG. 13, the change of the mode initially involves the following steps:

The operator finds that the machine is in the base mode. A large paper cassette is loaded and the lever arm 31 is rotated in a clockwise direction (step 1). This displaces the document feeding means 30 in position on the platen 20 for the LDC operation (step 2). A suitable mechanism (e.g., a gear) moves the drive mechanism into a position for engagement with the main drive M (step 3). The LDC mode switch S6 opens as the paper feeding means 40 moves to the LDC position and applies a logical 1 or +5 volt DC signal to a NAND gate 102 (FIG. 6) via a pull-up circuit 101A (step 4). The momentary switch S5 is positioned so that it momentarily closes and opens (step 5) after the LDC mode switch S6 operates. In response to the actuation of the momentary switch S5, the DC regular 88 is triggered into operation and causes the power supply to be latched in an on condition (step 6). The foregoing steps 1 - 6 initialize the control circuit (step 7) for the LDC mode. Steps 1 - 7 occur substantially simultaneously; their recited order merely refers to functional cause and effect.

Steps 1 - 7, as described in conjunction with FIG. 13, are manifested within the control logic depicted in FIGS. 6 - 11 in the manner described below wherein it is again assumed that the machine was in the base mode and that operator properly inserted the large paper cassette. The insertion of the large paper cassette conditions the large paper cassette sensing switch S4 (FIG. 6) to a closed state to indicate the presence of the large cassette. The closed state of the switch S4 signifies to the LDC logic that the large cassette is present. At this point, the home switch S1 is still actuated, that is, the scanning element 21 is still at the home position as shown in dotted lines (FIG. 3). AC power is supplied to the machine as interlock 63 (FIG. 4) is closed.

When the operator moves the lever 31 clockwise (step 1) to the LDC position, the document feeding means 30 is displaced onto the platen (step 2) at a position where it can feed the document original past the scanning station. The document original feed rollers 34 are brought in a position for engagement with the main drive M via the drive belt 41 - 42 and are driven by the main drive (step 3). The LDC mode switch S6, which is normally closed, is positioned to open as the feeding means 30 moves to the LDC position. This causes a pull-up circuit 101A (FIG. 6) to apply a +5 volt DC or logical 1 level to the NAND or LDC mode gate 102 through a first (a) of its two inputs. The other of the input (b) of the NAND gate 102 may be used to applying disabling signals $\overline{\text{FD}}$ when a machine failure such as paper jam is detected and indicated as a low level on conductor LD1.

The pull-up circuits 101A - 101E are of conventional design and comprise resistors R1 and R2 and a capacitor C1. The circuit is designed to provide two different levels of potential defining logical One (1) and Zero (0) states. For example, when switch S6 is closed, the resistor R2 is connected therethrough to ground and places a low level on the input a of the NAND gate 102 which is defined as a logical Zero (0). Conversely, when switch S6 is opened, the ground potential is removed from the resistor R2 and the 5 volt DC level reflected across the combination of R1 C1 is directly applied to input *a* of NAND gate 102 to define a logical One (1) level. The capacitor C1 provides an AC by-pass for transients which may occur during the opening and closing of the switch S6 to minimize transient noise which might otherwise falsely trigger the logic gate 102. Thus, with the machine in the base mode, a logical 0 level is applied to the NAND gate 102 due to switch S6; however, as the document feeder 30 moves to the LDC position, switch S6 opens to remove ground from the resistor R2 whereupon a logical 1 level is applied to input *a* of the NAND gate 102. At this point, the other input to NAND gate 102 as applied to pin *b* from input $\overline{FD}$ may be assumed to be a logical 1 since no machine failure should be present. It should be noted, however, that +5 volts DC has not yet been applied to the control circuitry because the DC regulator 88 is not yet actuated. Therefore, until the momentary switch S5 operates to trigger the regulator 88, pull-up circuits 101A - 101E will not have been enabled under the conditions being discussed.

After the LDC mode switch S6 opens (step 6) in this sequence, the switch S5 applies 18 volts DC momentarily to the five volt DC regulator 88 (FIG. 4). This momentary signal triggers the DC regulator 88 into operation to convert the AC input thereto into a five volt DC supply level and apply it to the logic circuitry. Thus, the momentary actuation of the switch S5, initializes the logic circuitry. Also the momentary actuation of the switch S5 takes the place of a depression of the PRINT button 53 or light original button 54 (FIGS. 3 and 4) as far as copy cycle initiation is concerned and obviates the need for a depression of the print button to initialize a copying operation. The logic circuitry is now initialized and ready to receive and process other input signals. Thus, at this juncture a logical 1 is applied to the upper input NAND gate 102. This input to NAND gate 102 together with a logical input of 1 from the $\overline{FD}$ input to pin *b* causes the NAND gate 102 to output a logical 0.

Thus far it has been assumed that the machine was in the base mode and the foregoing steps took place to change machine operation to the LDC mode. Suppose, however, that the machine is already in the LDC mode wherein the lever 31 of the paper feeding means has been previously rotated clockwise. In this case, the LDC mode switch S6 is already open. The LDC operation is initiated momentarily by actuating either the PRINT button 53 or the LIGHT ORIGINAL button 54 (FIG. 4) connected in parallel with the momentary switch S5. The actuation momentarily applies the 18 volt DC potential to trigger the regulator 88 which provides the +5 volts DC to initialize the logic circuitry (step 7) and hence condition the same for operation. In turn, the pull-up circuit receives +5 volts DC and applies a logical 1 to the top input of NAND gate 102. At this point, as stated before, the scanner element 21 is still at the home position.

Referring to steps 8 - 10 of FIG. 13, as the logic is initialized, the following events take place. The visual indicating means 50 is lighted and displays the WAIT advisory (step 8) to the operator. This is intended to advise the operator not to feed the document original at this time. Even if the operator should feed the document original by mistake, the logic will not recognize it since the copy paper feeding means PF (FIG. 1) is not yet in operation. At this time, the paper feeding operation is inhibited by the actuation of the LDC paper feed inhibit (FIG. 8: II; FIG. 1: II).

Referring to the details of the logic in FIGS. 6 - 11, more specifically, the foregoing steps of lighting the WAIT indication (step 8) and the energization of the paper feed inhibit (step 9) result from the scan carriage being in the home position and the document feeding means 30 being in the LDC position as follows. The logic elements involved in providing the foregoing function includes LDC mode switch S6, pull-up circuit 101A, NAND gate 102, NAND gates 103 and 104, OR gate 111, INVERTOR gate 113, SCR Q10, WAIT LIGHT 50, the 127 volt DC supply, SCR Q5, PAPER FEED INHIBIT solenoid II and the associated passive elements R6, R18, R24, diode R1 and RC bypass circuits BP10, and BP11. In operation, the opening of the LDC mode switch S6 causes the pull-up circuit 101A to apply +5 volts or logical 1 signal to the NAND gate 102. At this point, the other input to the NAND gate 102 at pin *b* is a logical 1. Capacitors C1 - 11 are used to shunt out noise signals from interfering with the operation of the logic in a conventional manner.

Here note that any type of machine failure condition signal $\overline{FD}$ detected by detack detecting or fuser overheat detecting means etc., is used by the LDC logic in the form of a failure condition signal applied as a logical 0 to the pin *b* of the NAND gate 102. This logical 0 input will prevent NAND gate 102 from attaining a low output in response to the condition of the LDC switch S6 and thus prevents the initiation of the LDC mode. As described in detail in pending application Ser. No. 348,828, the mentioned failure detected acts to place the machine in an interrupt mode. Upon removal of conditions that have caused the failure detection, the $\overline{FD}$ signal applied to input *b* of NAND gate 102 changes to a logical 1 thereby enabling an assumption of the LDC mode.

In response to the coincidence of logical 1 inputs from the failure condition detection input $\overline{FD}$ on lead LD1 and the opening of switch S6, the NAND 102 provides a logical 0 output signal. This low level output is applied to both inputs of NAND gate 103 which acts as an invertor to produce a logical 1 at the output thereof. This output is applied to the lower input of NAND gate 104.

Figure 9:
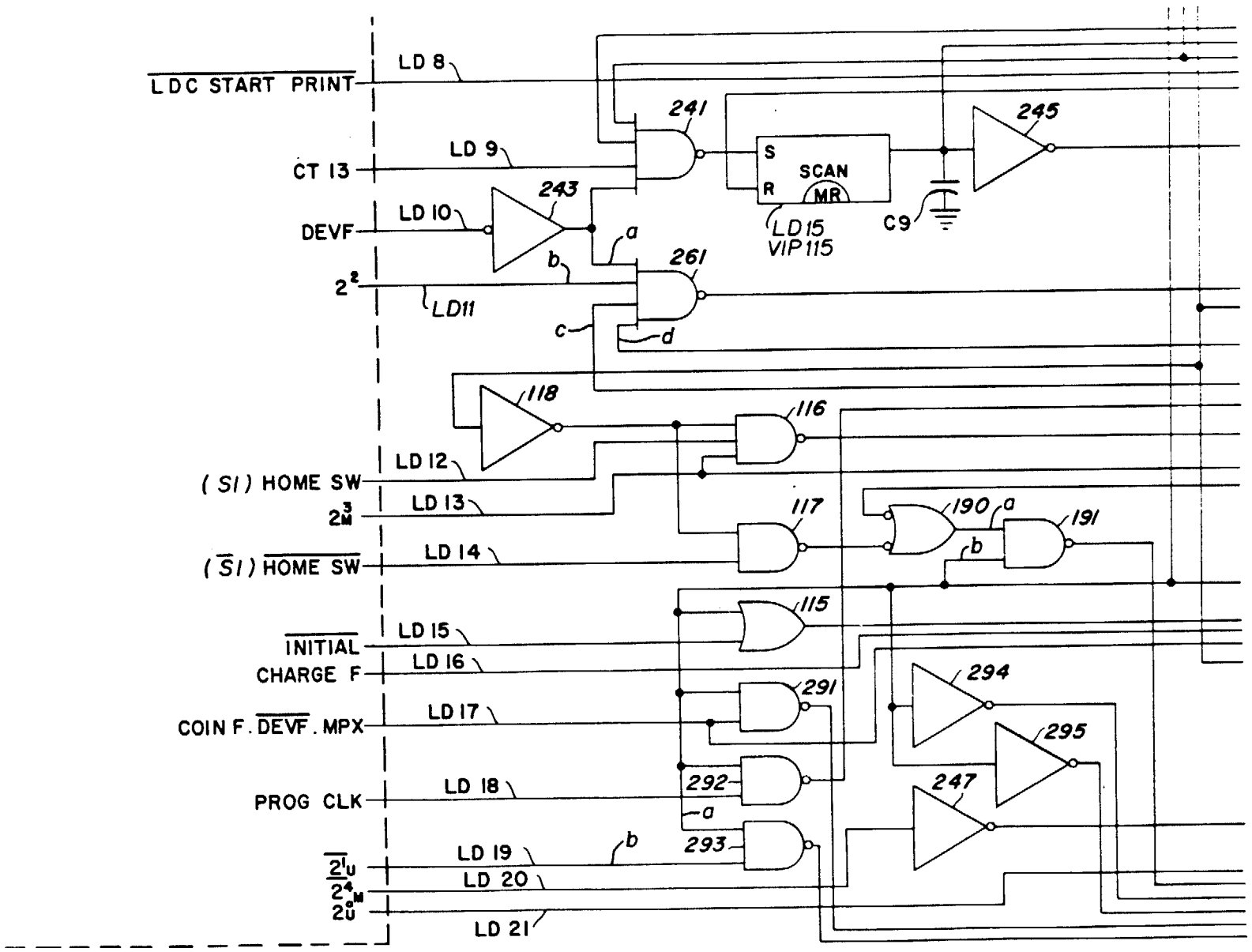
Figure 10:
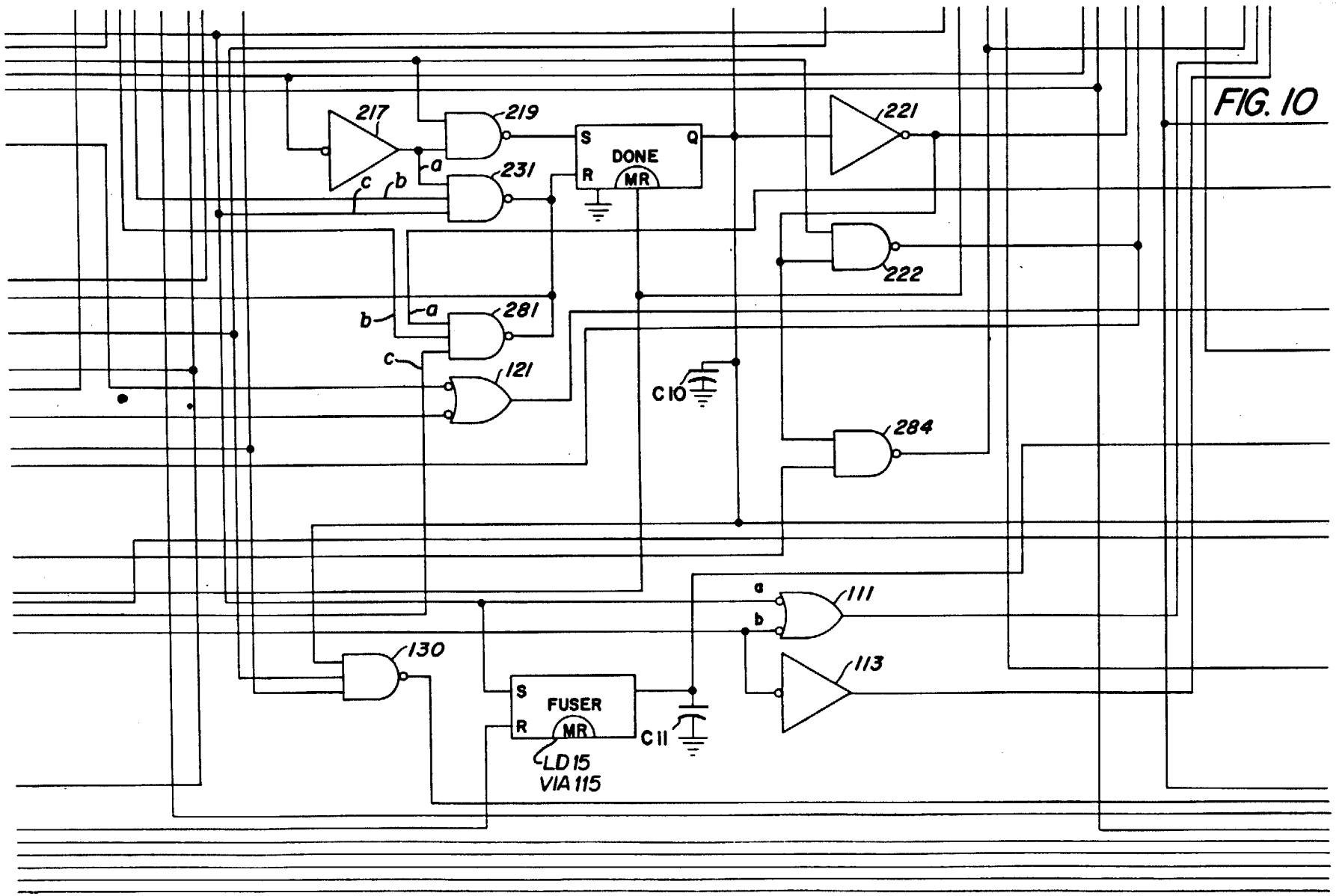

At this point, it may be noted that the NAND gate 104 has two inputs. The lower input, as aforesaid, is connected to the output of NAND gate 103 while the other input is connected through pull-up circuit 101B to the end of scan switch S2. S2 is open normally and closes when actuated by the scanning optics. It may be recalled, that the switch S2 is open because the scan carriage is not yet at the end of scan position. Thus, as the switch S2 is open, the pull-up circuit 101B applies a logical 1 to NAND gate 104. Under these conditions, both inputs to the NAND gate 104 are logical 1. The output of the NAND gate 104 is low. The output of NAND gate 104 is applied to the *b* input of OR gate 111 and to the Inverting gate 113 (FIG. 9).

The OR gate 111, whose inputs are inverted, acts to invert the logical 0 applied to the *b* input thereof and outputs a logical 1 to the control electrode of SCR Q10 via a resistor R24. Similarly, the Inverting gate 113 inverts the logical 0 level applied thereto from the output of NAND gate 104 to a +5 volts or logical 1 and applies it to the control electrode of SCR Q5 via a resistor R18. The SCRs Q5 and Q10 are of conventional design and have the control electrodes connected to a resistor and capacitor connected in parallel to form AC bypass circuits BP10 and BP11. Each of the bypass circuits BP 10 and BP11 is connected intermediate ground and the gate electrode of an associated one of SCR's Q5 and Q10. The anode electrode of the SCR Q5 is connected to a suitable DC source such as an unregulated 127 volt DC supply, via the PAPER FEED INHIBIT solenoid II. The anode of the SCR Q10 is connected to the same DC voltage source via a resistor R28 and the WAIT lamp 50. The anode is also shunted by a suitable resistor R6 to a ground to provide a low bias current to the WAIT lamp 50. The cathodes of both SCRs Q5 and Q10 are connected to ground through a diode R1 as shown. The gate electrodes of both SCRs respond to the logical 1 levels from gates 111 and 113 to become conductive. Once triggered into conduction, the necessary power for lighting the WAIT light 50 is applied (step 8) and causes the WAIT light to be energized. Thus the WAIT light is illuminated when the LDC mode switch S6 opens as the operator turns the LDC lever 31 clockwise to move the LDC document feeding means 30 into the LDC position. Similarly, when SCR Q5 conducts, power for actuating the PAPER FEED INHIBIT solenoid II is applied thereto so that the INHIBIT solenoid II prevents the rotation of the copy paper feed rollers 44 of the paper feeding mechanism PF (FIG. 1) from feeding of the copy paper (step 9). This continues until the scanning elements 21 and 22 reach the end of the scan position and close the end of scan switch S2 to open and deactuate SCRs Q5 and Q10 due to the high level output now provided by NAND gate 104.

Note also that with the machine set in the LDC mode and the consequent opening of LDC switch S6, buffer 64 (FIG. 4) is conditioned to operate in the LDC mode. This is made possible as the low output of the LDC NAND gate 102, under these conditions, is applied to the Inverting gates 153 and 155. In turn, the gates 153 and 155 apply enabling levels in the form of logical 1's to the LDC AND gates 141L - 148L. These same outputs are again inverted and also applied to disable the BASE MODE AND gates 141B - 148B via inverting gates 154 and 156. Consequently, the multiplexing circuit 64 is now conditioned to operate in the LDC mode.

As soon as the LDC logic sets up the buffer 64 to operate in the LDC mode, the multiplexing circuit 121M provides a print disabling signal in the form of logical 0 to a PRINT BUTTON circuit via output path 161. This disabling signal is used to disable the PRINT BUTTON 53 input of the machine. This means that as the lever arm 31 is displaced and actuates the momentary switch S5, the momentary actuation generates an analog to a print command, as aforesaid, while commands from the printer button per se are disabled. When the machine is switched back to the base mode, the PRINT DISABLE multiplexing circuit 121M is switched back to the BASE mode of operation and removes the low or PRINT DISABLE signal on conductor 161.

The output of the NAND gate 102 is also applied to the output lead $\overline{L}$ (07). This output can be utilized in a suitable manner to generate, for example, logical 0 at $\overline{L}$ which may be used to show that there is no jam condition and that the buffer is now in the LDC mode while its complement or a logical 1 at the output annotated 014 may be employed to indicate either a jam condition exists or the LDC mode operation has not been established.

The remaining mode changing steps are illustrated as steps 12 - 19 in FIG. 13. Briefly, the remaining steps entail a deactuation of the home switch S1 (step 12), a deenergization of the scan inhibit solenoid (step 13), clearing and holding the master counter CTR1 in the clear state (step 14) awaiting the arrival of the carriage at the end of the scan position (step 15), enabling the pawl mechanism to retain the carriage and the scanning optic means in a stationary position at the end of scan position (step 16), and a releasing of the inhibit on the paperfeed solenoid (step 18) to enable the copy paper feeding mechanism. The WAIT light is turned off at this time. (Note that the document original feeding rollers 34 are connected to the main drive M so that it continues to be driven for the entire duration of the LDC mode. The machine cycle-out count also begins so that, if no document original is fed after a given period of time, the machine is cycled out (step 19) and is shut down. If the document original is fed in time, then the cycle-out step does not take place and the machine enters into copying cycle in LDC mode.

Before tracing the details of the steps 10 - 19 in the logic, as an aside, note that the LDC logic comprises several latches designated in FIGS. 6 - 11 as SCAN, EXPOSURE, DONE, and FUSER latches. In operation, each of these latches is reset when the logic is initialized by input $\overline{\text{INITIAL}}$ applied to lead LD 15 and an OR gate 115. This input takes the form of a negative gong pulse applied to the master reset lead MRs of the latches (shown specifically only for the DONE latch). Once reset by the initializing signal, the latches operate in the usual manner depending upon the input signals applied to the set S or reset R inputs of the respective latches. Thus, upon initialization, the latches are reset to a predetermined state and and thereafter, the outputs of the latches are determined by the most recent input signals applied to the S and R inputs thereof.

Returning to the details of the steps 10 - 19, once the logic is initialized, the master counter CTR1 is enabled and begins to count (step 10). At the end of count 8, the scan solenoid is energized (step 11) in the following manner:

The operations of the SCAN multiplexer circuit 124M, include logic elements which comprise the end of scan switch S2, the pull-up circuit 101B, NAND gate 104, INVERTER 118, NAND gate 116, OR gate 121, and the SCAN MULTIPLEXER circuit elements in the dashed block 124M per se. When the momentary switch S5 (FIG. 4) triggers the logic via the regulator 88, the counter CTR1 begins to count. At this point, subsequent to initialization, the output of the NAND gate 104 is low because the end of scan switch S2 is not yet closed. Note that the +5 volts DC is applied via the pull-up circuit 101B to upper input of NAND gate 104 and that at this point, NAND gate 103 will also apply a logical 1 to the lower input of NAND gate 104. As a result, NAND gate 104 applies a low output or logical 0 to the input of the Inverting gate 118. The inverting gate 118 therefor applies a high or logical 1 input to upper input of NAND gate 116. As the home switch S1 remains actuated at this time, a logical 1 or high input is also applied to the center input of NAND gate 116 through conductor LD12. When the counter CTR1 reaches a count of 8, the $2^3$ M signal goes to a logical 1 and this high level is applied through lead LD13 to the NAND gate 116. At the count of 8, all input conditions for NAND gate 116 are met and a logical 0 output is applied to OR gate 121. The OR gate 121, whose inputs are inverted, in turn applies a logical 1 to the scan multiplexing circuit 124M at the upper input of AND gate 144L. In turn, the multiplexing circuit 124M which is enabled, as aforesaid for LDC mode operations, gates the logical 1 through gates 144L, 134 and 124 to provide a logical 1 output signal on conductor 164, SCAN MPX. Suitable means, such as a solenoid (FIG. 1), is provided to respond to the logical 1 output of the scan signal multiplexing circuit 124M and causes the scan carriage and associated optics to be displaced toward the end of scan position. As the scan carriage leaves, the home switch S1 is opened or deactivated (step 12). When the home switch S1 opens, the scan solenoid is deenergized, (step 13) and the master counter CTR1 is cleared (step 14). Referring particularly to the LDC logic, it will be seen that with the home switch S1 in an open condition, the HOME SW input applied to the middle input of NAND gate 116 goes to a logical 0. This causes the output of NAND gate 116 to go to a logical 1. The OR gate 121, whose inputs are inverted, then causes the AND gate 144L to be disabled whereupon NOR gate 134 and invertor 124 of the buffer 64 act in conjoint to apply a disabling or logical 0 to output 164, SCAN MPX. The Zero (0) level at output 164 causes the scan solenoid I (FIG. 1) to be de-energized (step 13) through the action of a circuit similar to Q5 and its related components.

When the home switch S1 opens, the complemented input $\overline{\text{HOME SW}}$ on conductor LD14 goes from the logical 0 to a logical 1. The resulting positive transition is applied to the lower input of NAND gate 117 whose other input is already enabled from the output of invertor 118. The low is processed through OR gate 190 and NAND gate 191 to clear the counter via the low output $\overline{\text{LDC MAS CTR CLR}}$ on lead 012 (step 14). More specifically, the inverting gate 118 applies a logical 1 to the upper input of NAND gate 117 since the end of scan switch S2 is still opened. This should be evident by tracing the gates 102, 103, 104 and 118. Therefore, when the home switch S1 is opened, a logical 1, $\overline{\text{HOME SW}}$ is applied through lead LD14 to the lower input of the NAND gate 117, the $\overline{\text{HOME SW}}$ signal going to a logical 1 as the scanning means leaves the home position and opens the home switch S1. In turn the NAND gate 117 changes its output from logical 1 to logical 0. The OR gate 190, whose inputs are inverted, changes its output from a logical 0 to a logical 1 and applies the resulting high level to the upper input of NAND gate 191. At this point the lower input of the NAND gate 191 is at logical 1 as the logical 1 output of the NAND gate 103 is applied thereto. NAND gate 191 therefore applies a logical 0 or clear signal to the master counter CTR1 via the path 012 (step 14). Note that the other input at pin *b* of the NAND gate 191 is logical 1 from the NAND gate 103 so long as the LDC mode switch S6 remains open, signifying that the machine is in LDC mode and no failure is indicated on input $\overline{\text{FD}}$. Conversely, if the machine is not in the LDC mode, a logical 0 is applied to the lower input of NAND gate 191 from the gate 103 to prevent resetting of the counter CTR1.

Once started by the operation of the SCAN solenoid, the scanner carriage continues to move to the end of position (step 15). When the carriages reaches the end of scan position, the end of scan switch S2 (step 17) is closed an a pawl and ratchet mechanism is caused to latch the carriage and prevent it from flying back or returning to the home position (step 16). For a more detailed description of the mechanism associated with the means for locking the carriage at the end of the scan position, one may refer to the above mentioned pending application Ser. No. 284,687.

Referring to the logic circuitry, when the scan carriage reaches the end of scan position, it closes the end of scan switch S2. As S2 closes, it applies a logical 0 to the upper input of the NAND gate 104 via the pull-up circuit 101B. In turn, the NAND gate 104 changes its output to a logical 1 and applies it to the invertor 118. The output of the invertor 118 goes low and applies a logical 0 output to the upper inputs of NAND gates 116 and 117. At this point, it will be recalled that the opening of the home switch S1 has already disabled the NAND gate 116 through the application of a logical 0 to the middle input thereof.

However, when the output of NAND gate 117 goes high with the closing of the end of scan switch S2, the counter CTR1 is allowed to start counting since the clear level on conductor 012 is released. Also, the PAPER FEED INHIBIT solenoid is allowed to release and the WAIT indication is extinguished (step 18). More specifically, as the scanning means reaches the end of scan position, it actuates the switch S2 and closes it. In turn, the SCRs Q5 and Q10 are turned off by the closing of the switch S2 due to a loss of signal at their gate electrodes. Thus, when S2 closes ground is applied to the pull-up circuit 101B. In turn, the pull-up circuit 101B, NAND gate 104, Inverting gate 113 and OR gate 111 respond and apply a logical 0 to the trigger leads of the SCRs Q5 and Q10. Furthermore, the master clock counter is now allowed to count because the disabling of NAND gate 104 and the action of INVERTOR 118 cause NAND gate 117 to be disabled whereupon a logical 1 is applied through the action of OR gate 190 and NAND gate 191 to the counter via the output path 012 ($\overline{\text{LDC MAS CTR CLR}}$), as aforesaid. This allows the counter to start counting again, by removing the forced clear signal or logical 0 on conductor 012. Thus, in short, the steps 11 through 18 as outlined in FIG. 13 are implemented by the LDC logic as the scan carriage moves from the home position to the end of the scan position and the home switch S1 and the end of scan switch S2 are opened and closed, respectively.

Once the mode is changed as described above, the machine cycle out time count commences (step 19). If the document original is not fed into the document feeding means 40 prior to the expiration of a given period of time, such as 26 seconds, the machine will cycle out. The machine cycles out as follows: Once the counter is started, again upon the actuation or closing of the end of scan switch S2, it continues to run till a certain count or period of time (e.g., 16 seconds) runs out. If the operator has not yet fed the document original, then the counter CTR2 provides a signal $\overline{2^1u}$ and applies this signal through an input lead LD19 and NAND gate 293 to shutdown path 016 (LDC EXT SHUT DOWN FIG. 9) for causing an extended shut down cycle. The foregoing occurs so that if no document original is fed in time, no count clear signal will appear at the master counter clear path 012 LDC MASTER CLR. (The manner in which master clear signal appears at the output of NAND gate 191 is described below in connection with the LDC mode of operation).

Referring to FIG. 9, once the input lead LD19 goes to logical 1 from the $\overline{2^1u}$ input, then the lower input of NAND gate 293 assumes this logical 1 level. The upper input of NAND gate 293 is already at a logical 1 from the output of NAND gate 103 in the LDC mode. Consequently, a low or LDC EXT SHUT DOWN signal appears at the output lead 016 and causes machine shut down.

In summary then, the mode change entails the following. The operator places copy paper or sheets of large or small size in the paper tray. The copy papers may be in a cassette form. If the machine is in the LDC mode, i.e., if the document original feeding means is in the engaged position, the PRINT or LIGHT ORIGINAL button is pressed. In response to this actuation, the control logic circuitry including the LDC logic responds and initializes the machine. If the machine is in the base mode, i.e., if the document original feeding means is not in the engaged position, the operator rotates the lever arm of the feeding means in a clockwise direction so that the feeding means is brought into engagement and becomes operative. Suitable sensing means (e.g. S5) is used to sense the fact that the machine is being changed to LDC mode from the base mode or is already in the LDC mode and mandates an appropriate initializing sequence. The LDC mode sensing means (S6) conditions the machine logic so that LDC logic outputs are selected or multiplexed to provide necessary signals for actuating various means in setting up the machine in the LDC mode. The LDC logic is so designed that it provides output signals for enabling the scanning means to move from the home position to the end of scan position. Suitable sensing means (S1 and S2) are utilized by the LDC logic in completing the steps necessary in setting up the machine in LDC mode. In the present illustrative embodiment, suitable means (e.g., a pawl and ratchet mechanism), used in providing the flyback operation to return the scanning means to the home position for each new copying cycle in the base mode, are also used in moving the scanning means to the end of scan position and retaining them in this position for the LDC mode of operation. Thus, in accordance with the present invention, control circuitry is provided in a reproducing machine designed to operate in different modes that includes means for sensing the machine status in terms of its mode and means for changing the machine automatically to a new setting in response to a command.

B. THE LDC MODE OF OPERATION

The following describes a cycle of operation of the machine in the LDC mode in making copies with the scan carriage and optical arrangements locked in place for the LDC mode and the document original feeding means 30 in an engaged position as shown in solid lines in FIG. 1. Referring to step 0 as depicted in FIG. 14, it will be seen that two situations may obtain at the start of the LDC cycle. The first situation is that the machine just completed the mode change and has not yet cycled out. In this case, the document original must be fed prior to the termination of the cycle out time interval which, for example, expires 26 seconds after the end of scan switch S2 has been closed. The second situation is that the machine is already set in the LDC mode but not yet started due to a completed timing out sequence or the like. In this case, the operator may start by pressing the PRINT 53 or LIGHT ORIGINAL button 54 to start the machine (step 0).

Referring back to the first situation, when the document is fed, the leading edge of the document will open or actuate either one or both of the normally closed paper sensing switches S7 and S8 (step 1). In response to the opening of switches S7 and S8, ground is removed from pull-up circuit 101C to cause the application of a logical 1 level to input of a NAND gate 211. This action, as will be seen below, causes the NAND gate 211 to clear the counter CTR1 and initialize the LDC logic elements for a copy cycle. More particularly, as a high level is applied to input *b* of NAND gate 211 from the output of NAND gate 103 in the first situation being discussed, the logical 1 level applied to input a will cause the output of the NAND gate 211 to change from a logical 1 to a logical 0. This signal is applied to a one shot multivibrator 213 through an OR gate 214, whose inputs are inverted, and triggers it. In turn, the multivibrator changes its output from logical 1 to logical 0. This output of the multivibrator 213 is applied to conductor 011 where it is employed as clearing signal $\overline{\text{LDC ONE SHOT CLR}}$ for the counters CTR1 and CTR2. Backtracking a bit, if a document original is not fed before the cycle out time interval (e.g. 26 seconds) then the multivibrator 213 would not be triggered since the switches S7 and S8 would remain closed. Consequently, the counters CTR1 and CTR2 will continue to count and, at a $2^1$u count, the +5 volt D.C. regulator will be turned off and the machine shut down.

Upon a termination of the duty cycle of the multivibrator 213, the clearing pulse developed from the actuation or opening of the switches S7 and/or S8 terminates leaving counters CTR1 and CTR2 in a cleared condition. Counter CTR1 then starts again to count from zero and provide count signals. At the same time, the LDC logic goes through certain logic steps and provides output signals necessary to operate the controlled elements and effect xerographic operation in the following manner.

Referring to FIG. 14, as the counter begins to run in response to the actuation of the document sensing switches S7 and S8 (step 3), the pull-up circuit 101C causes the NAND gate 211 to provide a logical 0 output in the manner described above. Thereafter, as will be explained in detail, the enabling of NAND gate 211 causes a DONE latch to be set (step 4) and the LDC logic circuitry is responsive thereto to provide a photoreceptor charging signal via the charge multiplexing circuit 128M (step 5).

Turning specifically to the details of the logic, the output of the NAND gate 211, under the control of the document switches S7 and S8, provides a logical 0 signal, as aforesaid which is inverted by INVERTOR 212 to set the DONE latch through the enabling of NAND gate 219 and the action of one-shot multivibrator 213 which is enabled through an OR gate 214 whose inputs are inverted. Here, it should be noted, that the DONE latch was previously reset by the master reset or $\overline{\text{MR}}$ input which is generated by the $\overline{\text{INITIAL}}$ signal applied through gate 115 from conductor LD15. Conversely, the DONE latch is reset at the completion of the copy cycle by a logical 1 signal, at the output of NAND gate 211 after the document has been fed. This 1 level is then applied to NAND gate 231 which causes an actual resetting of the DONE latch. The logical 0 generated by NAND gate 231 occurs in response to the enabling of the gate by the simultaneous existence of logical 1 levels on each of the three inputs thereto. The logical 1's on these inputs are generated in the following manner. The upper most input is applied from INVERTOR 217 which receives a logical 0 from NAND gate 215 upon an enabling of this gate wherein the input to NAND gate 215 which is here of principal concern is supplied from the Q output of the one shot multivibrator 213 when the one shot is triggered. The center input to NAND gate 231 is developed from the output of NAND gate 211 which senses paper in the document feeder when the machine is in the LDC mode. Therefore, this input to NAND gate 231 goes high to enable resetting when the document to be copied has been fed through and is out of the feeder 30. The lower input to NAND gate 231 is applied from INVERTER 242 which receives a logical 0 from the LDC EXPOSURE latch signifying that exposure is off. Thus, it will be seen that the DONE latch is reset after (1) resetting of the counters by the one shot multivibrator 213 is initiated, (2) the exposure latch is OFF and (3) the document to be copied has passed from the feeder 30 in the LDC mode and hence, the DONE latch is set during the copy cycle and reset when the LDC copy cycle has been completed.

As noted before, the one shot multivibrator 213 was triggered through the action of OR gate 214 whose inputs are inverted and NAND gate 211 which sensed the presence of paper in the document feeder during LDC mode operation. In this manner, the output of OR gate 214 changes from a logical 0 to a logical 1 and causes the one shot multivibrator 213 to trigger. Once triggered, the one shot multivibrator 213 generates a positive and a negative going pulse at its outputs at pins Q and $\overline{Q}$, respectively, until the duty cycle terminates whereupon the Q and $\overline{Q}$ output levels are reversed. The resulting positive going pulse from Q prior to termination of the duty cycle is applied to NAND gate 215.

Figure 6:
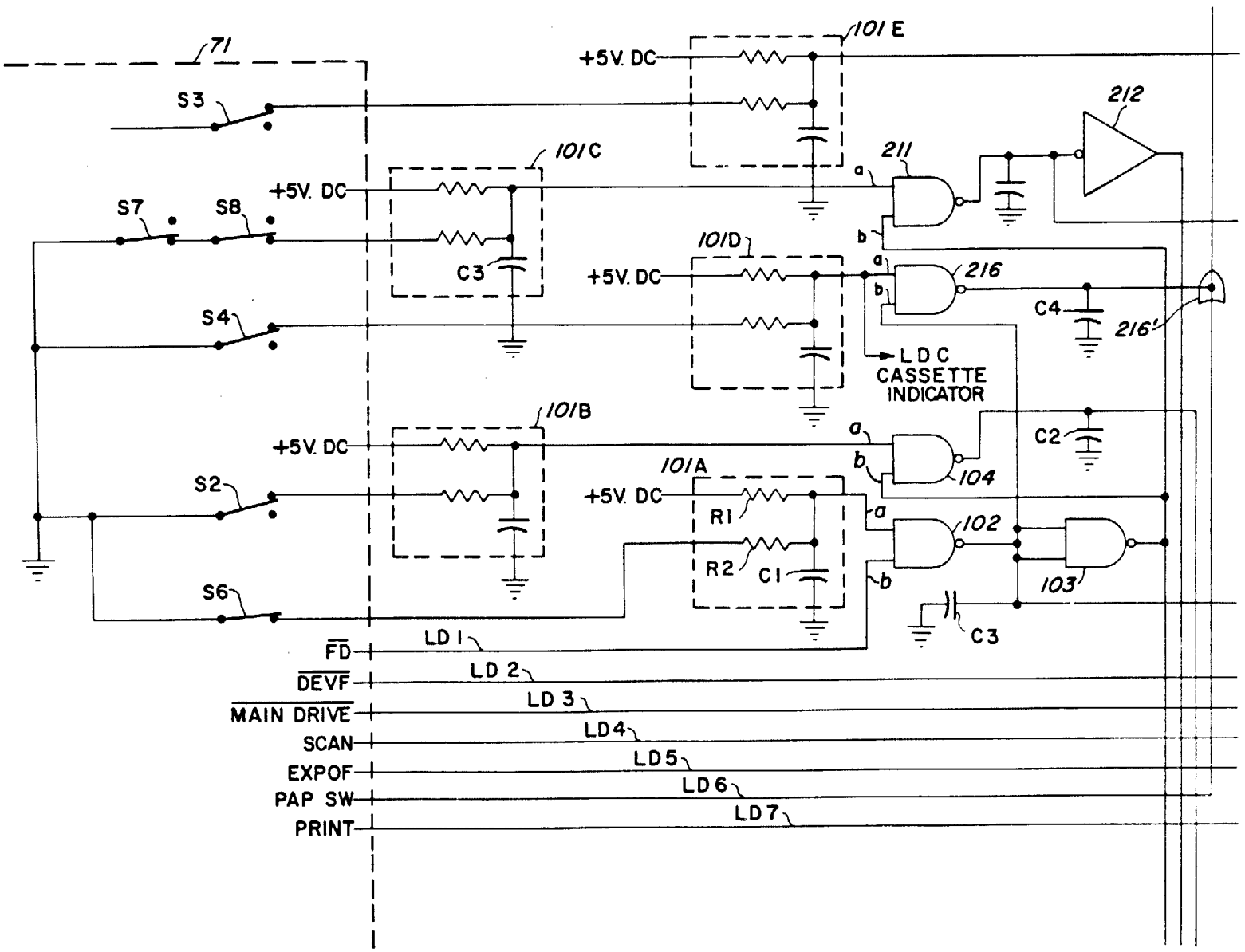
Figure 7:
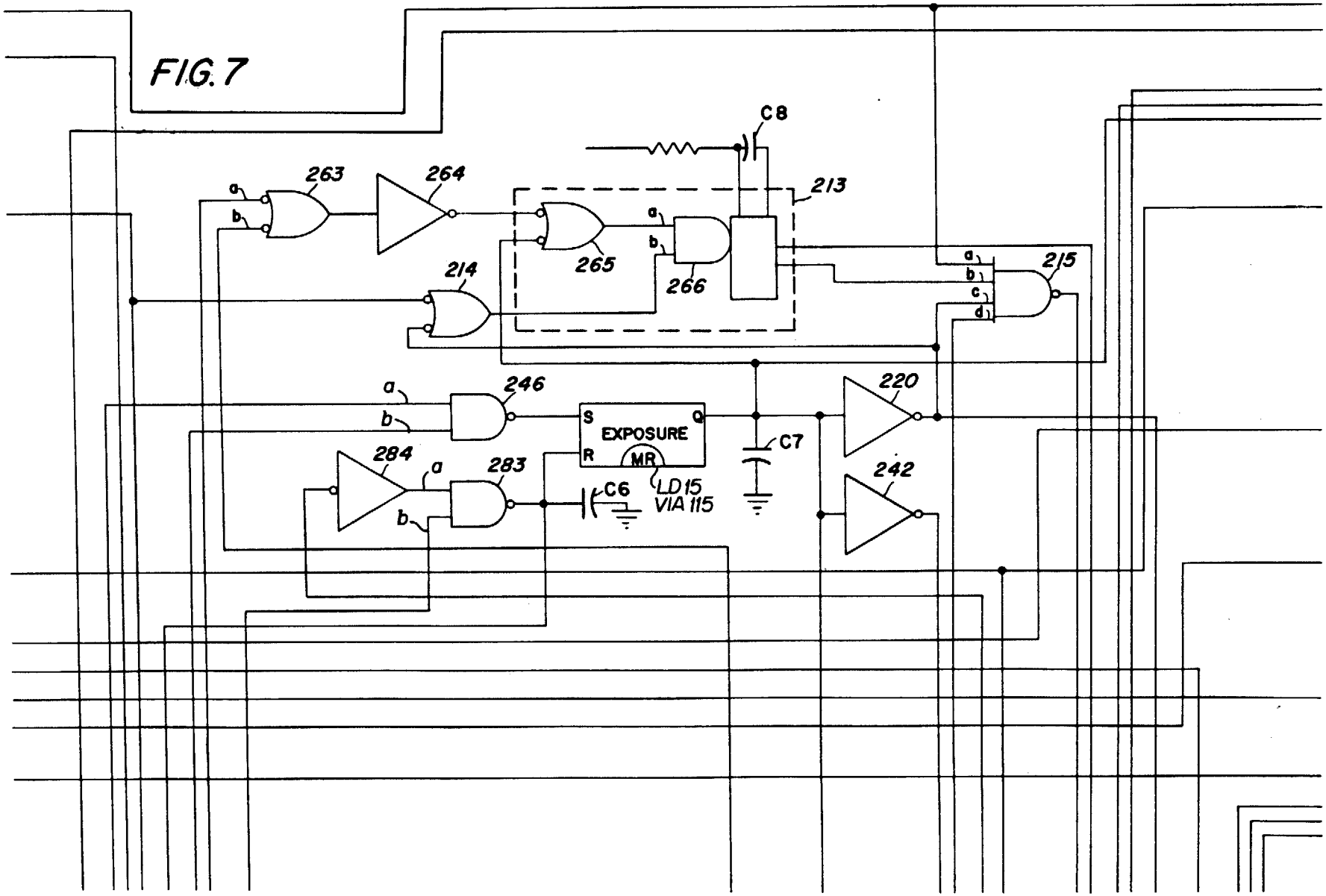

The four inputs at the pins *a, b, c* and *d*, of the NAND gate 215 control the selective enabling of this gate in the well known manner in that a low output is produced only when all of the inputs thereto are high. Therefore, referring to the logic circuit, the input a to NAND gate 215 will be a logical 1 when the presence of the large paper cassette is sensed by the switch S4 as aforesaid and the LDC mode is established or any time copy paper is in the machine regardless of the mode. The presence of a large paper sheet is indicated by the copy paper switch S4, as shown in FIG. 6, since the switch S4 is arranged to close and apply ground to the pull-up circuit 101D when a large paper cassette is present. In turn, the pull-up circuit provides a logical 0 to input a of the NAND gate 216. At this point note that the gate 216 is disabled by the LDC NAND gate 102 output which is low. The output of gate 102 is low if there is no jam ($\overline{JAMF}$ or $\overline{FD}$ is logical 1) and the LDC mode is set. Hence, the NAND gate 216 applies this intelligence from the presence of large cassette in the LDC mode, in the form of a logical 1 to input pin a of the NAND gate 215. The output of 216 is high in the LDC mode, no matter which size cassette or paper is loaded, but low if in the base mode and a large cassette is in place in the machine. This prevents operation of the machine in base mode with a large cassette. If the machine has no copy paper supply in place in the cassette, this condition is detected by the paper sensing switch PAP SW (FIG. 3) and applied via LD6 and wired OR gate 216', to the output path 00 in the form of logical 0 to energize the ADD PAPER lamp 51 and to alert the operator.

Suppose, for instance, that the machine is in the base mode and a large size paper cassette is in place. The large size paper condition is detected by the large cassette sensing switch S4 while the base mode is indicated by a high at the output of NAND gate 102. Therefore as both inputs are high, the gate 216 provides a logical 0 output and the OR gate 216' provides a logical 0 output causing the ADD PAPER lamp to be energized. However, if the machine is in the LDC mode, the gate 216 provides logical 1 output signal regardless of the size paper in place which is applied to input a of the NAND gate 215 via the OR gate 216' and prevents the lighting of ADD PAPER lamp. The foregoing features, in effect, make it possible to use the machine to make copies on large or small papers when the machine operates in the LDC mode but prevents the machine from copying on large paper when it operates in the base mode.

Now referring to input C of the gate 215, it will be appreciated that prior to starting a copy cycle, the Exposure latch is in a reset state due to the initializing signal applied to the MASTER RESET MR input thereof so that the Exposure latch provides a logical 0 output at this point in the operation being described. This output is inverted by an Inverter 220 and applied in the form of a logical 1 to input pin *c* of NAND gate 216. Similarly, the input to pin d of NAND gate 215 is at this point a logical 1 because the compliment of the initializing signal $\overline{INITIAL}$ from input path LD15 as applied to OR gate 115 is a logical 1 as is the output of NAND gate 103 which is also applied to OR gate 115.

Thus, in summary, at the beginning of a copy cycle, the POSITIVE going pulse from the Q output of the one shot multivibrator 213 is gated through the NAND gate 215, if copy paper is loaded. The gate 215 inverts the positive going pulse into a negative going pulse and applies it to an invertor 217 as well as to NAND gate 241. The invertor 217 in turn applies the positive going pulse to the lower input of NAND gate 219 and the upper input of NAND gate 213. The upper input of NAND gate 219 is at a logical 1 as the inverted output of NAND gate 211 is supplied thereto through invertor 212. It may be recalled that at this point, the leading edge of the document original has already been sensed as the switches S7 and/or S8 are opened by the document to provide a high input to the upper input of NAND gate 211 while the lower input thereto is also high due to the condition of NAND gate 103. This low output of NAND gate 211 is therefor inverted by INVERTOR 212 and applied as a logical 1 signal to the upper input of the NAND gate 219. The NAND gate 219 therefore applies a negative going pulse to the Done latch to cause the same to be set. When set, the Done latch provides a positive or logical 1 output to its Q output. (Note that when the $\overline{INITIAL}$ reset signal resets the Done latch, it causes a logical 0 to be applied to the Q). The output of the Done latch is also directly applied to the LDC charge multiplexing circuit 128M via AND gate 148L and NOR gate 138 so this high level is applied to output 168. In short, the foregoing conditions, namely, sensing of the leading edge of a document to be copied and presence of paper causes the LDC logic to operate and provide a charge control signal for actuating the charging means (not shown) of the xerographic machine (FIG. 14, Step 5) at the output of the buffer 64, as a step of the xerographic process. Conversely, when the document to be copied is fed through and exposure latch is off, the Done latch is reset by the action of NAND gate 231, to await the next cycle of operation.

At this point, it may be recalled that with the LDC switch S6 open for the LDC mode, the LDC NAND gate 102 sets the inverting gates 153 and 155 to apply a logical 1 to the LDC mode selection AND gates 141L through 148L. The same LDC mode selection signal is inverted by invertors 154 and 156 to disable the base mode selection AND gates 141B through 148B. As a result of the foregoing, the output of the Done latch is applied to the LDC charge selection circuit via the LDC mode AND gate 148L and provides a charge signal for effectuating the charging steps. In the base mode, the charge multiplexing circuit 128M would provide a logical 1 output or charging signal by applying a logical 1 output from the charge latch output CHARGEF (FIG. 5: 71C), as applied via LD16 to input a of AND gate 148B, to output 168 of the multiplexer 128M. However, under the conditions presently being discussed, the AND gate 148B is disabled by a logical 0 applied to the input b from the inverting gate 156.

Referring again to the flow chart in FIG. 14, when the counter CTR1 reaches a count of 13, (Step 6),the scan solenoid is energized (step 7) in the following manner. As stated earlier, the output of NAND gate 211 goes low as soon as the leading edge of a document is to be copied in the LDC mode. This low is inverted at gate 212 and applied to the upper input of NAND gate 241 to partially condition this gate. The remaining three inputs to NAND gate 211 are controlled from top to bottom, by the output of the Exposure latch through INVERTOR 242, the count 13 output of counter CTR1 on line LD9 and the inverted output of the Developer latch for the base logic as applied on line LD10, respectively. At this point, the Exposure latch is not set and provides logical 0 output. This means that the Invertor 242 applies a logical 1 to its respective input to the NAND gate 241. Similarly, the Developer latch of the base logic provides a logical 0 signal for DEVF input on line LD10 at this point and this logical 0 is inverted by gate 243 and applied in the form of logical 1 to the lowest input of NAND gate 241. The output of the development latch (FIG. 5; *7a*) takes the stated conditions since is was reset initially and has not been set at this point. Referring to FIGS. 5 – 11, the resetting of the development latch during initialization may be seen by an appreciation that for an operator to initiate a copying operation in the LDC mode, either the LDC lever 31 is moved to the LDC position or PRINT button 53 is pressed. In response to this action, the LDC mode switch S6 opens so that when the pull-up circuits are energized by the action of the momentary switch S5, a low is produced at the output of NAND gate 102 and translated to a high by NAND gate 103. This high is inverted by gate 295 whereupon the PWR $\overline{\text{INITIAL}}$ output on lead 014 goes low to cause resetting through the Master Resets, as aforesaid.

Thus, three of the four inputs to NAND gate 241 reside at a logical 1 and hence are enabled. Accordingly, when the count 13 signal from the counter CTR1 is applied to line LD9, NAND gate 241 is enabled and provides a logical 0 output. Thus, the count 13 signal (CT13) from the master counter CTR1 applied via the count input lead LD9 causes the SCAN latch to set and provide a logical 1 output. In turn, the SCAN latch output is inverted by gate 245 and applied to one input of OR gate 121, whose inputs are inverted. The OR gate 121 in turn applies a logical 1 signal to the LDC mode select AND gate 144L of the scan multiplexing circuit 124M.

The SCAN multiplexing circuit 124M provides the high or logical 1 output signal on lead 164. With the scan solenoid actuated, the output of the scan multiplexing circuit 124M is employed to enable the feeding of copy paper. This signal may be applied to a suitable means, such as a solenoid and SCR actuating means of the type shown in connection with paper feed inhibit solenoid. When the scan multiplexer output goes to a logical 1 from a logical 0, in response the scan latch being set, the SCR energizes a single cycle clutch (FIG. 1, III) and allows it to rotate. This enables the copy paper feeding means to feed the copy paper. For the more detailed description of an illustrative example of the foregoing, one may refer to the aforementioned copending application Ser. No. 284,687.

Returning to the flow chart of FIG. 14, at a count of 16, the Exposure and Fuser latches are set and provide necessary signals through the corresponding multiplexer circuits 125M and 127M to implement the exposure and fusing steps (9 and 10) in the exemplary xerographic copying process.

These processing steps are implemented in the LDC logic according to the instant invention through the operation of the SCAN latch and the counter CTR1. When the scan latch is set it provides a logical 1 at its output to partially enable NAND gate 246 at its upper input with a logical signal at the end of step 7. The counter CTR1 provides a count 16 signal ($2^4$M) in the form of a high so that the complemented input on lead LD20 which is connected to an invertor 247 is low. Prior to count 16, the output of invertor 247 resides at a logical 0 and upon the arrival of the complement of the count 16 input, the output of gate 247 changes to a logical 1 which is applied to the lower input of NAND gate 246. The coincidence of logical 1's at both inputs to NAND gate 246 causes the output of this gate to go to a logical 0. This sets the Exposure latch which provides a high output. The output of invertor 22 therefor changes to a logical 0 which is applied to the Exposure multiplexer circuit 125M to change its output on lead 165 from a logical 1 to a logical 0 through the action of AND gate 145L, OR gate 135 and inverting gate 125. The logical 0 on lead 165 is then used as a control signal for enabling the exposure means in the xerographic machine. This implements the steps of imagewise exposing the document original in the xerographic process.

As noted in FIGS. 8 and 11, the exposure control signal $\overline{\text{EXP}}$ $\overline{\text{MPX}}$ present on lead 165 is also applied to the upper input of AND gate 141B for generating a signal insuring a disabling of print button 53. Gate 141B is already disabled in the LDC mode since the center input to AND gate 141B is low. This is the case since the NAND gate 102 applies a logical 0 to the INVERTOR 153 and the output produced thereby is again inverted by gate 154 so that a logical 0 is applied to AND gate 141B. Consequently, in the LDC mode, AND gate 141B applies a disabling signal in the form of a logical 0 to the output path 161 which is used to disable the PRINT button. So long as the PRINT button disable signal is applied to the machine, the operator cannot affect the operation of the LDC mode of the machine by tampering with the PRINT button 53.

The operation of the Exposure latch also causes the fuser of the machine to be energized as indicated in step 10 of FIG. 14. The output of the Exposure latch is used to set the LDC Fuser latch through invertor 242. The LDC Fuster latch was reset through the master reset MR when the logic was initialized. This caused its output a to be logical 0.

Now, the change in the output of the gate 242 from a logical 1 to a logical 0 places a negative transition on the set input of the Fuser latch. The Fuser latch in turn, is set and changes its output to a logical 1 for application to fuser multiplexer circuit 127M. The fuser multiplexer 127M provides in response thereto a fuser control signal in the form of a high on output lead 167. This fuser signal (FUSER MPX) is used to turn on the fuser (FIG. 1) in the xerographic machine to provide the fusing energization according to step 10. In summary, then, the Exposure and the Fuser latches are operated at the count of 16 ($\overline{2^4M}$) by the counter CTR1 and, as a result, the imagewise exposure and fusing operations of the copying process are implemented.

The counter continues to count and when it reaches count 20 (step 11), the Scan latch is reset (step 12) and the counter is cleared (step 13). The clearing of the counter and resetting of the scan latch is accomplished under the control of the one shot multivibrator 213 which is again triggered at count 20 to implement both the functions of clearing the counter and resetting the scan latch. The triggering of the one shot multivibrator is controlled under these conditions by the output of NAND gate 261 which is connected to input a of OR gate 263. The NAND gate 261 is preconditioned to trigger the one shot 213 at count 16 when the $\overline{2^4M}$ signal on lead LD20 is applied to the inverting gate 247 so that a high input is applied to the NAND gate 261. At the count of 16, the top and bottom inputs to the NAND gate 261 are also held at logical 1 due to the condition of INVERTOR 243 and the EXPOSURE latch set previously. Thus, under these conditions the input to the inverting gate 243 on lead LD10 is at a logical 0, due to the condition of the Development latch 71A (FIG. 5) in the base logic which is configured to be set, with the machine in the LDC mode, by a low level (DEV SET LDC) produced on lead 09 from the output of NAND gate 130. More particularly, when the Done and Exposure latches are set, the NAND gate 130 goes from a logical 1 output condition to a logical 0 at the count of 8. Referring to the NAND gate 130, it will be seen that the upper two inputs come from the Q outputs of the Exposure and Done latches and thus reside at a logical 1 or enabling level when the latches are set. Up to count 8 ($2^3M$) the lowest input to NAND gate 130 is at a logical 0 since the input on lead LD13 is low; however, this input goes high at count 8. Therefore, after count 8 and the setting of the Exposure and Done latches, NAND gate 130 changes from a logical 1 to a logical 0. The output of the NAND gate 130 is applied to the output lead LD9 D9 to provide a setting signal (DEV SET LDC) for the development latch to actuate the development means of the xerographic machine. Thus, under these conditions, the top input to NAND gate 261 is at a high level to enable this gate. The LDC Scan latch was previously set at the count of 13 (step 6). This actuated the solenoid I and one cycle clutch (FIG. 1) and fed a sheet of copy paper. Since their functions have been performed a resetting of the Scan latch through the action of the NAND gate 261 and the ONE SHOT multivibrator 213 is appropriate. Up to a count of 20, as aforesaid, all of the inputs to NAND gate 261 are in a high state as a result of the operation of the logic to this point except for the input connected to the $2^2$ input on conductor LD11. Therefore, at the count of 20, the input on the count lead LD11 goes high to fully enable the NAND gate 261. The NAND gate 261 accordingly changes its output from a logical 1 to a logical 0. The output of the NAND gate 261 is applied to the *a* input of OR gate 263, whose inputs are inverted, into the invertor 264 to trigger the ONE SHOT multivibrator 213. When the ONE SHOT multivibrator 213 switches, it applies a reset pulse or low level to the $\overline{Q}$ output thereof. This level persists for the duty cycle of the One shot and is applied to the reset input R of the Scan latch to cause resetting in the manner indicated in step 12. Additionally, the multivibrator 213 also provides a negative going output pulse at its $\overline{Q}$ output and a positive going output pulse at its output Q. The negative going pulse is applied as the $\overline{\text{LDC ONE SHOT CLEAR}}$ signal via 0 11 and clears the master counter CTR1. (step 13)

Resetting of the Scan latch changes its output to logical 0. In turn, the gates 245, 121 and the scan multiplexer circuit 124M respond and provide a logical 0 output on lead 164 to de-energize the scanning means. The one shot clear pulse on lead 011 clears the counter CTR1 and when released at the end of the duty cycle allows it to start counting again (step 14). This point in the cycle time is analoguous to the scan carrier deactuating the home switch S1 in the base mode of operation. In the LDC mode, however, the document original moves while the scanning arrangement is locked in a stationary position and the relative movement between document orginal and the scanning element is used, in effect, to simulate the base machine.

After clear, the master count CTR1 continues to count. At a count of 8 (step 15) the developer latch is set (step 16) and the clutch mechanism in the machine is energized. The counter CTR1 applies count 8 signal ($2^3M$) to input lead LD13 and lower input of NAND gate 130 (FIG. 9). At this point, the upper two inputs from the Done latch output Q and from the Exposure latch Q are at logical 1 as aforesaid. Therefore, at a count of 8, the NAND gate 130 provides a logical 0 output to lead 09. This signal DEV SET LDC is applied from the output lead 09 to the associated development means in the xerographic machine to cause a development of the image-wise exposed photosensitive insulating layer 12 in the usual manner (step 16).

The counter continues to count to the count of 141 (step 17) and sets the coincidence latch COINF (FIG. 5) in the base machine (step 18) and clears the counter CTR1 (step 19). In the base machine, the coincidence latch COINF is utilized to signify the fact that the number of the copies that have been set by the operator have been made and is initially set to a desired number of copies. The base logic is designed so that the coincidence latch sets after the count of 141 after the coincidence between the copies made and set occurs. In the base machine, this will occur after the last copy set by the dial is made. For the more detailed explanation, one may refer to the above-mentioned copending application Ser. No. 348,828 filed on Apr. 6, 1973.

In the LDC mode, the present logic is designed to utilize the foregoing features in the base machine that provide the count 141 output. More specifically, referring to FIGS. 8 - 11, the setting signal for coincidence is applied to NAND gate 291 through input lead LD17. This signal is applied to the lower input of NAND gate 291 in the form of logical 0 for COINF-DEVF MPX state. In turn, the gate 291 applied a logical 1 signal to the output lead 015 which acts as the 141 DISABLE signal. It is noted, as indicated in the abovementioned application Ser. No. 284,687, that in the LDC mode, the machine is designed to make one copy at a time so that coincidence occurs after each copy is made. Thus, the timing pulse count of 141 is initiated after the development step for the one copy is started. The present logic for the LDC mode is designed to utilize output signals from the base logic network to provide the count 141 signal and for clearing the counter. As noted, the base logic is utilized in energizing the developer at the count of 8, resetting the coincidence latch COINF in the base logic at the count of 141 and for clearing the counter CTR1.

The means for enabling and disabling the paper motion sensing means associated with the paper jam detection circuit in the copier/duplicator machine is also utilized by the machine in the LDC mode of operation. In the LDC mode of operation, the LDC logic counts up to 84 (step 20) after the counter is cleared in response to a count of 141. Circuits for detecting machine failure conditions, such as jam detect circuit in the base machine, provide a machine failure signal upon the detection of such condition. This signal is utilized by the LDC logic and is applied thereto through the failure detect path LD1, which is connected to the lower input of the LDC mode gate 102. When a failure condition is indicated by a logical 0 applied to the lower input of the LDC mode gate 102, the LDC mode gate 102 is disabled and the machine is put into an interrupt mode for clearance of the jam or the like as described in detail in a copending application Ser. No. 348,828 filed on Apr. 6, 1973. If the failure condition is not detected, for a given interval, indicated by step 22, then certain means used for jam condition detection are disabled (step 23). If no failure is detected, then at this point, the machine goes into shut down cycle.

C. SHUT DOWN CYCLE

The shut down cycle of the machine in the auxiliary or LDC mode of operation is illustrated by the flow charts of FIG. 15. The shut down cycle may involve two situations. The first situation occurs where the trailing edge of the copy sheet from the paper cassette is sensed by the trailing edge sensing switch S3 before the end of the document feeding station by the document sensing switches S7 and/or S8. A second situation involves the converse of the first situation described above, that is, the trailing end of the document is sensed by the switches S7 and/or S8 before the trailing edge of the copy sheet is sensed by the switch S3. The first situation is initially considered.

Assume no malfunctions have occurred in the copy cycle and copy paper length is less than that of the document original. Under these conditions, the trailing edge of the copy paper from the paper cassette is sensed by the switch S3 and in response thereto the LDC logic resets the DONE latch. More particularly, the switch S3 opens as it senses the trailing edge of the copy paper and provides a logical 1 signal through the pull-up circuit 102E to the center input of NAND gate 281 to partially enable this gate. The other two inputs of NAND gate 281 are under the control of the outputs of the Exposure latch via the EXPOF signal and the outputs of coincidence and development latches signified by input COINF $\overline{\text{DEVF}}$ MPX as applied to lead LD17. At this point, the Exposure latch is in its set condition and applies a logical 0 to the output lead 08 via invertor 220 and conversely, the base machine logic applies a logical 1 to the upper input of NAND gate 281 via the lead 165 EXPOF, and lead EXPOF. Thus, the coincidence and development latch status signal. COINF, $\overline{\text{DEVF}}$· MPX provides the last of the necessary signals to the lower input of the NAND gate 281. In response to the coincidence of the three logical 1 signals, the NAND gate 281 generates a negative going pulse. The significance of the control of NAND gate 281 by the EXPOF and COINF. $\overline{\text{DEVF}}$· MPX signals is that if there is no more original to copy in the document feeder, the copy cycle may be shut down. This condition is reconized when the Developer latch is still set and the Exposure latch is also set. The simultaneous occurrence of these signals causes a logical 0 at the output of the NAND gate 281 which acts to reset the DONE latch.

The negative going pulse from the output of NAND gate 281 is applied to a reset input R of the DONE latch to reset (step 26) this latch to a DONE state where a logical 1 output is produced at the output of invertor 221. The DONE latch provides a logical 0 output signal at the Q output thereof in a reset condition and this is applied to the charge multiplexer circuit 128M to provide a negative going pulse at output 168 which is employed to turn off the charging means. This output is also applied through gate 130 and lead 09 as the DEV SET LDC signal which is employed to turn off the developer when count clear signals are generated through the action of gates 221, 222, 190, 191 and master counter clear path 012. (step 29).

The counter is held clear until the document original deactuates or closes the document sensing switches S7 and/or S8 (step 30). Once these switches are closed, the counter again starts to count. This is accomplished through gates 211, 212, 222, 190, 191 and lead 012 $\overline{\text{LDC}}$ $\overline{\text{MAS CTR CLR}}$ path.

Note that when the Done latch is reset and the document switches S7 and S8 are still actuated or opened by a document original, the output on lead 012 is held at logical 0 by NAND gate 191 which receives a logical 1 from OR gate 190, whose inputs are inverted, in response to a logical 0 from NAND gate 222 which senses the state of the Done latch and the logical 1 from the INVERTER 212. The output lead 012 being at a logical 0, clears the counter CTR1 and holds it cleared until the level on lead 012 changes to a logical 1. This occurs when the document switches are closed. As soon as the clear signal is removed, the counter again begins to count.

Reclosing of the switches S7 and/or S8 restarts counter CTR1 (step 31) and outputs a pulse as a billing count pulse which is applied through NAND gate 286 (step 32) to lead 02. At the count of 8, the $2^3$M signal applied to lead LD13 enables NAND 283 to reset the Exposure latch (step 34). In turn, the Exposure latch deenergizes the exposure means through the invertor 220 and the multiplexing circuit 125 of the buffer 64. Note that the upper input to NAND gate 283 resides at a logical 1 level from the reset condition of the Done latch due to the action of invertors 221 and 284 as well as NAND gate 284. The Done latch provides a logical 0 at its output at this point.

In response to this enabling, the NAND gate 283 applies a low or negative going level to the reset terminal R of the Exposure latch and causes it to be reset (step 34). During the interval when the Done latch is reset and the Exposure latch is still set, the three inputs to the billing NAND gate 286 are set and thereby enable the NAND gate 286 to provide an appropriate billing count signal to the billing meter suitably connected to the present logic circuitry (step 35) as described in detail in a copending application Ser. No. 344,321 filed on Mar. 23, 1973 (LDC billing meter).

While the Exposure latch is set, indicating a copy cycle in process, it turns on the WAIT visual indicating means through gates 242 and 111. At a count of 8, the WAIT lamp 50, which signifies an LDC "not ready" condition, is extinguished (step 36). This signifies to the operator that the LDC machine is now ready to receive another document original for processing. At this point, the *b* input of the OR gate 111, whose inputs are inverted, is a high since the end of scan switch S2 is closed. The *a* input is low when LDC Exposure latch output Q is high or set and high when the output Q is low or reset. A low or logical 0 input to either of the two inputs *a* or *b* of OR gate 111 enables the WAIT light. Since in the LDC mode, with the optics already at the end of scan position, the *a* input effectively controls the operation of the Wait lamp, it will be seen that when input *a* of gate 111 goes high, when the Exposure latch is reset, the Wait lamp is extinguished as indicated by block 36.

The fuser as indicated by step 38 is turned off when the Fuser latch is reset by the count 256 signal from the second counter CTR2 applied to the reset terminal R of the Fuser latch (steps 37 - 38) through lead LD 21. The LDC fuser latch reset causes the LDC fuser select gate 147L to apply the fuser turn-off signal or low to output lead 167 via the NOR gate 137 and INVERTOR 127 (step 38). When the second counter counts to the count of 1536 (step 39), the main power latch (FIG. 5 71B) provided in the base logic is reset (step 40). The reset MAIN power latch de-energizes the main drive motor and the +5 volt D.C. regulator. The de-energized main drive motor shuts the machine down. Note that the main drive multiplexer 126M kept the main drive running while the machine was in the LDC mode and main power latch was set.

In the second situation where the document original trailing edge is sensed first by the deactuation or closing of switches S7 and S8 and thereafter the trailing edge of the copy sheet is detected by the switch S3, the shut down sequence occurs in the following sequence. When the trailing edge of the document original is sensed, the switches S7 and/or S8 close. The coincidence latch, COINF, sets signifying a coincidence condition and the counter CTR continues until the trailing edge of the copy sheet is detected by switch S3. Upon a detection of the opening of the switch S3, a logical 1 is applied to the center input of the gate 281. The upper and lower inputs to gate 281 already residue at a logical 1 condition for the same reasons described above so that gate 281 is fully enabled and outputs a logical 0 signal. This resets Done latch and triggers the one shot multivibrator 213 via gates 284 and 283 in the manner described above. The multivibrator 213 provides a counter clearing signal at the $\overline{Q}$ output thereof which is applied to lead 011 LDC ONE SHOT CLR. Gate 215 is disabled at this point in spite of the action of the One Shot 213 because the Exposure latch is set so that a logical 0 is applied to input *c* of gate 215. At this point, the shut down sequences for both situations become the same and steps 31 - 41, as described above, take place to turn off the main power and shut down the machine.

With the exception of a scanning optics malfunction, malfunction shutdown and recovery within the LDC mode of operation is identical to that employed for the basic mode. Thus, when the malfunction latch FD in the base logic is set, the NAND gate 102 simulates the LDC mode switch being in the base mode by providing a high output. Electrically, the machine remains in the base mode until the malfunction latch JAMF is reset. Upon restarting the machine after the malfunction condition is cleared, any paper left in the large document head is fed out. The input of the one shot multivibrator 213 is only sensitive to positive transitions of the input *b* of the AND gate 266. A malfunction causes the logic to revert to the base mode and this applies a reset signal to the MR input of all LDC latches including the Done Latch. Since the Done latch is in a reset state and the document switches are actuated, gates 222, 190 191 hold the counter clear. Also, since the scan carriage is locked in the end of scan position, a monitoring of an optics malfunction need not take place in the LDC mode.

The bias level control is described in conjunction with FIG. 16. The operation of the development bias level is related to the light original or regular copying process selected by an operator through use of the LIGHT ORIGINAL 54 and PRINT 53 buttons. FIG. 16 includes a portion of the detailed logic circuitry of FIGS. 6 - 11 redrawn for clarity. In the base mode, the developer bias latch 311 in FIG. 16 or 71A in FIG. 5 is connected to respond to the actuation signals from the Exposure latch 71E of the base logic. The logic is configured so that in the base mode, the light original button 54 can be pressed at the beginning or any time during the copy run and will cause the development bias latch 311 to set the bias level to a higher than normal level to enhance the quality of the copy image. At the end of the copy cycle, when the exposure means is reset the development bias latch 311 is also reset and this in turn causes the machine to operate in the normal print mode. The output Q of the development bias latch 311 is at a logical 0 to define normal development bias and to a logical 1 for high bias levels employed for a light original.

However, in the LDC mode, because of the logic configuration of the buffer 123M, the development bias latch 311 is reset only when the print button 53 is pressed and otherwise the development bias continues to apply the higher bias for the light original 54. The rationale behind this is that when the operator operates the machine in the base mode, she will press the PRINT 53 or LIGHT ORIGINAL 54 button at the beginning of the copy run in order to make copies and leave it there. In the LDC mode, however, the operator changes over the machine from the base mode to the LDC mode by moving the lever clockwise and this takes place of the depression of one of the light original 54 or print 53 buttons. This being the case, the copy being made will be processed according to normal copy conditions unless the LIGHT ORIGINAL button is deliberately pressed. Once set, the latch 311 retains the state and enables the means to provide high bias level voltage (logical 1). This state continues so long as the machine does not shut down. It is assumed that the document original material being copied will more likely than not have somewhat consistent quality which will require light original treatment, if at all, for a plurality of sequential copies. That is, the quality of the document original continues to be poor and requires enhanced images obtainable by a high development bias setting. This being the case, the logic is configured, as above, so that the copying machine continues to operate according to light original conditions in the LDC mode without a depression of the LIGHT ORIGINAL button 54 at the beginning of succeeding copying operations in which shut down does not occur so long as an initial setting occurs. In the LDC mode, once the LIGHT ORIGINAL 54 is pressed, a resetting of the development bias latch occurs when the operator presses the PRINT button 53 or allows the machine to cycle out and shut down at the completion of the copying process.

For the record, it is here noted that various patents and pending applications referred to above are expressly incorporated into this application by reference. Various modifications and changes may be made to the present invention within the scope and spirit thereof as described above in conjunction with an illustrative embodiment. As stated previously, the machine can be adapted to act as a multi-copy duplicator in the LDC mode of operation. Thus, when the Done latch is set signifying the completion of a copying operation, the same or a different original can be automatically fed and successive copies made therefrom. Automatic implementation of this duplicating feature may be accomplished by adding an automatic recirculating document feeder RDF of a suitable design that responds to the output of the Done latch and automatically feeds the same or different document originals. Also, while the present invention is described within the context of conventional xerographic copier/duplicator apparatus, clearly it need not be so limited. The invention may be applied with little or minor modifications to non-xerographic copying machines using treated papers or photographic principles.

What is claimed is:

1. In an automatic reproducing machine comprising:
movable scanning means;
document original feeding means;
xerographic step implementing means including means for charging a photoreceptor layer; means for image-wise exposing said layer to form a latent electrostatic image; means for developing said electrostatic image; and means for transferring the developed image to a copy sheet; the improvement comprising:
a control circuitry for operating said machine selectively in a first mode, wherein said document is held stationary and said scanning means is moved past the document to form a scanned image or in a second mode, wherein said scanning means is held stationary and said document feeding means feeds said document past said scaning means to form an image,
said control circuitry first logic means for operating said machine in said first mode and second logic means for operating said machine in said second mode, said first and second logic means generating a plurality of signal outputs for actuating said xerographic step implementing means;
means for generating a signal indicative of the mode in which said machine is set; and
buffer means for receiving said actuating signal outputs and for selectively applying them to said implementing means, said buffer means including multiplexing means responsive to said mode signal for gating the desired actuating signal outputs corresponding to the mode in which the machine is set to said implementing means.

2. The control circuitry according to claim 1, wherein said buffer means prevents undesired actuating signal outputs from being applied to said implementing means.

3. The circuitry according to claim 2, wherein said signal outputs for actuating said xerographic step implementing means are generated by a plurality of latch circuits.

4. The circuitry according to claim 2, wherein said control circuitry includes means for enabling said machine to make copies on copy sheets solely up to a first size when said machine is operating in said first mode and to make copies on copy sheets up to said first size or a second size larger than said first size when said machine is operating in said second mode.

5. The circuitry according to claim 4, further including means for generating a signal indicative of copy sheets of said second size, and
wherein said enabling means is responsive in said first mode to said signal indicative of said second size copy sheets, and to said mode signal, for generating a faulty condition signal, and means for interrupting the operation of said machine in response to said faulty condition signal.

* * * * *